US006299008B1

(12) United States Patent
Payne

(10) Patent No.: US 6,299,008 B1
(45) Date of Patent: Oct. 9, 2001

(54) TRANSPORT AND STORAGE SYSTEM

(75) Inventor: Edward Payne, Fairfax, VA (US)

(73) Assignee: BOH Environmental, LLC

( * ) Notice: Subject to any disclaimer, the term of this patent is extended or adjusted under 35 U.S.C. 154(b) by 0 days.

(21) Appl. No.: 09/407,075

(22) Filed: Sep. 28, 1999

(51) Int. Cl.[7] ..... G65D 88/54
(52) U.S. Cl. ..... 220/1.5; 220/23.87
(58) Field of Search ..... 220/1.5, 23.87, 220/23.86, 23.83; 410/82, 91

(56) References Cited

U.S. PATENT DOCUMENTS

| | | | | |
|---|---|---|---|---|
| H1477 | | 9/1995 | Payne . | |
| 2,439,423 | * | 4/1948 | Fowler . | |
| 2,489,024 | * | 11/1949 | Gaynor . | |
| 2,954,003 | * | 9/1960 | Farrell et al. . | |
| 3,061,134 | | 10/1962 | Fesmire et al. . | |
| 4,052,084 | | 10/1977 | Propst . | |
| 4,122,761 | | 10/1978 | Westin et al. . | |
| 4,143,588 | | 3/1979 | Exler . | |
| 4,355,723 | | 10/1982 | Loeber . | |
| 4,726,486 | | 2/1988 | Masuda . | |
| 4,860,913 | | 8/1989 | Bertolini . | |
| 4,875,595 | | 10/1989 | Van Valkenburg . | |
| 4,976,365 | | 12/1990 | Seo . | |
| 5,052,569 | | 10/1991 | Cooper . | |
| 5,069,352 | * | 12/1991 | Harbolt et al. | 220/1.5 |
| 5,186,330 | | 2/1993 | McClure . | |
| 5,191,742 | | 3/1993 | Romig et al. . | |
| 5,193,700 | * | 3/1993 | Lyman et al. | 220/1.5 |
| 5,289,933 | | 3/1994 | Streich et al. . | |
| 5,301,479 | | 4/1994 | Romig . | |
| 5,356,206 | | 10/1994 | Van Valkenburgh . | |
| 5,447,407 | * | 9/1995 | Weaver et al. | 414/528 |
| 5,449,082 | | 9/1995 | Reynard . | |
| 5,511,908 | | 4/1996 | Van Valkenburg et al. . | |
| 5,595,315 | * | 1/1997 | Podd et al. | 220/1.5 |
| 5,704,475 | | 1/1998 | Abbott . | |
| 5,735,639 | | 4/1998 | Payne et al. . | |
| 5,785,591 | | 7/1998 | Payne . | |
| 5,931,617 | * | 8/1999 | Kroll et al. . | |
| 6,010,021 | * | 1/2000 | Zuidam et al. | 220/1.5 |
| 6,015,055 | * | 1/2000 | Bonerb et al. | 220/1.5 |

OTHER PUBLICATIONS

8 Ebrhard, Cam–Type Door Locks, "No. 5663 Recessed Cam–Type Door Lock With Water Seal", p. 149.
12 Ebeerhard, Miscellaneous, "Large Folding Footstep/Handhold—Patented", P. 186.
Tandemloc, Inc., "Container Securing Fittings".
AAR aarcorp.com, "AAR Cadilliac—Containers".
KNAACK, "Jobmaster® Chests".
Garrett Container System, Inc. "General Purpose Cargo Container".
Ref: 48B7385, Ring Assembly Working Capacity 5,000 Lbs. PMP05111.
Plate Nut, PMP82105.
http://www.cascom.army.mil/rock_drill/f_Photo_Archives/Veicles_and _convoys/PLS_with _Cont.

* cited by examiner

*Primary Examiner*—Stephen Castellano
(74) *Attorney, Agent, or Firm*—Bacon & Thomas, PLLC

(57) ABSTRACT

A transport and storage device including a cargo container, a system for positioning at least one removable storage module inside the container, and a system for releasably securing the positioned storage cabinet to the container.

31 Claims, 31 Drawing Sheets

FIG. 1
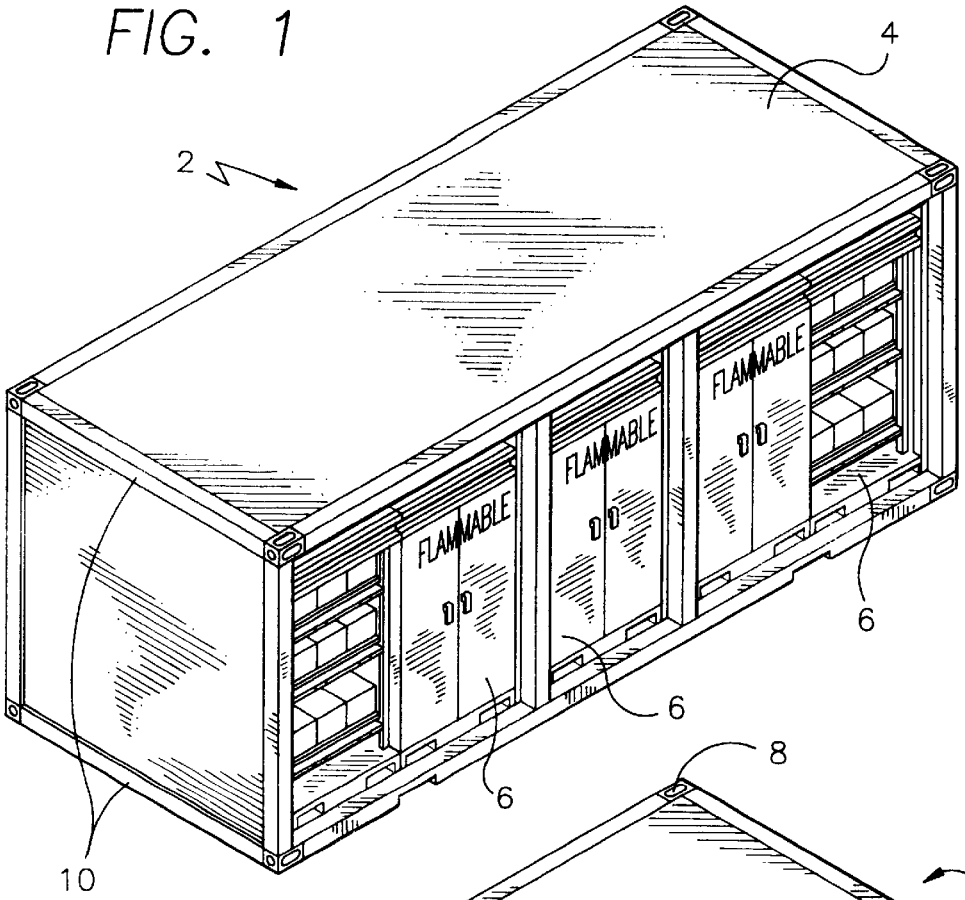
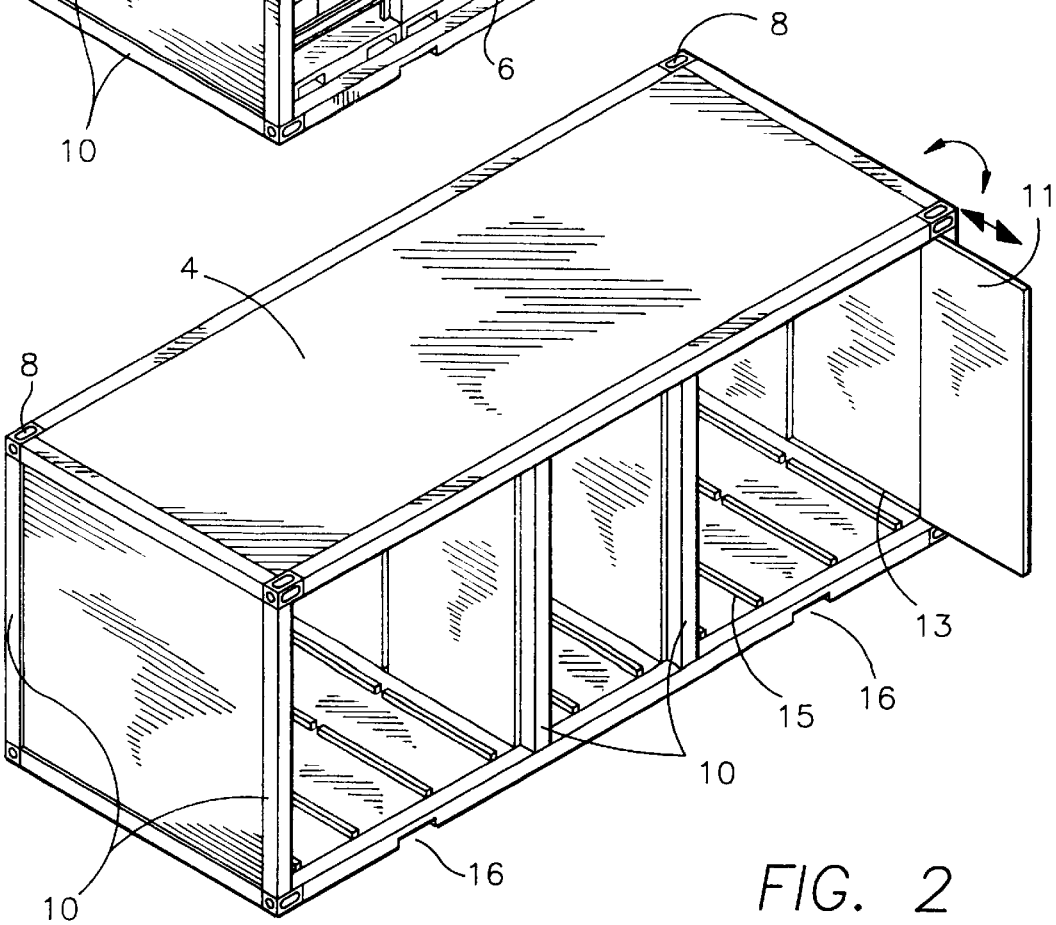
FIG. 2

TRANSPORT AND STORAGE SYSTEM

BACKGROUND OF THE INVENTION

1. Field of the Invention

The technology described here generally relates to receptacles, and, more particularly, to freight containers and freight accommodations on freight carriers.

2. Description of the Related Art

In recent years, the United States military establishment has rediscovered the importance of being able to safely and efficiently deploy equipment and supplies during foreign expeditions. For hazardous materials, U.S. Pat. No. 4,875,595 issued on Oct. 24, 1989 to Van Valkenburgh discloses a storage enclosure having a containment pan supported on a base frame to allow for visual inspection of the underside of the pan. U.S. Pat. No. 5,356,206 issued on Oct. 18, 1994, also to Van Valkenburgh, discloses another hazardous material storage enclosure with secondary containment shelves that are suspended from a sub-roof assembly.

U.S. Statutory Invention Registration H1477 issued on Sep. 5, 1995 to the present inventor discloses a mobile containment structure having a plurality of modular shelving units bolted to the floor of the structure for housing and storing cans of paint, drums of lubricant, and the like. U.S. Pat. No. 5,511,908 issued on Apr. 30, 1996 to Van Valkenburgh et al. (including the present inventor) discloses another mobile safety structure having a removable and grated floor which allows access to a containment pan underneath the floor. U.S. Pat. No. 5,735,739, issued to the present inventor and others on Apr. 7, 1998, discloses another mobile safety structure formed by tandem and/or stacked modular units. Finally, U.S. Pat. No. 5,785,591 issued on Jul. 28, 1998 to the present inventor discloses yet another mobile safety structure with five compartments that are separated by fire-proof walls.

In addition to hazardous materials transport systems, a wide variety of other logistical support systems are now containerized in order to speed troop deployments. As shown in the patents noted above, the military uses a wide variety of specialized containers to not only transport various cargoes in compliance with national and international requirements, but also to store and secure this equipment in the theater of operations. Higher readiness requirements and more limited opportunities for the pre-positioning of military supplies in foreign countries also mean that many military units must store at least some of their supplies in these containers while they are stationed at home between deployments. Since this cargo is often pre-packaged into conventional cardboard boxes which are then stacked sided-to-side in end-loaded containers, the entire cargo must often be removed from the container and the boxes in order to locate just one particular item. The leftover boxes must then be collected and disposed of, or recycled, before the container can be reloaded with the remaining stores.

These and other logistical problems can be particularly troublesome for bulk items or "small stores." In this regard, U.S. Pat. No. 4,860,913 to Bertolini discloses a cargo container fitted with a plurality of steel storage cabinets which are integrated into the structure of the container so as to maintain their position and shape when the container is subject to external forces during transportation. In particular, the cabinets are bolted to the side walls of the container, and to each other, with an aisle between them so that articles inside the cabinets can be accessed only by entering through doors at one end of the container, and then opening a particular drawer into the aisle. The cabinet drawers cannot be accessed from outside the container, nor can the cabinets be easily switched from one container to the next.

The subject matter of each of the patents discussed above is hereby incorporated by reference into the present disclosure.

SUMMARY OF THE INVENTION

The invention described here addresses these and other drawbacks of conventional transport and storage systems by providing a device which may include various features, such as a cargo container, means for positioning at least one removable storage module inside the container, and means for releasably securing the positioned storage module to the container. The positioning means may include a socket, or other type of receptacle, for receiving at least a portion of the storage module, such as a foot of the module. The securing means may include a container securing fitting for engaging or clamping the storage module to the cargo container. Other quick-release mechanisms besides container securing fittings may also be used to secure the storage module to the cargo container.

The container securing fitting is preferably fixed to a bracket on the inside of the cargo container, and preferably on the floor of the cargo container, for removably engaging a corresponding bracket on the outside of the storage module, preferably on the bottom side of the storage module. Folding steps and/or other climbing aids may be arranged on at least one side of the cargo container for providing access to the roof of the container. In addition, a removable mezanine and/or stairs may be secured to the outside of the cargo container, preferably using container securing fittings or other quick release mechanisms to releasably secure these structures to corner fittings on the cargo container.

The invention also relates to a transport and storage device, including a cargo container and a door pivotally supported on the container by a hinge mounted on an inside surface of the door. The door is preferably arranged so that the hinge and "hinged edge" of the door nearest the hinge are arranged entirely inside the cargo container. The hinged edge of the door may include an angled projection arranged such that it is received by a concave lip in the container when the door is closed. In particular, the concave lip may be L-shaped so that the angled projection extends substantially perpendicular to the front surface face of the door, and preferably also extends along the entire height of the hinged edge of the door. A weather seal may be arranged between the projection and the L-shaped lip. In addition, the doors may be arranged to move in and out of the container when the door is open, such as by using rollers or slides on the doors which are fit into tracks mounted inside the container, or vice-versa.

The invention also relates to a transport and storage device including a cargo container having an unobstructed access opening and a pair of doors hinged to opposite edges of the access opening. At least one of these doors has an angled projection extending from its "free edge," which is opposite the hinged edge, and the other of the doors has a concave, and preferably L-shaped, lip extending from its free edge for receiving the angled projection when the doors are closed. At least one of the doors may also include a second angled projection extending from the hinged edge of that door so that the concave and/or L-shaped lip on the cargo container receives the second angled projection when the doors are closed.

The cargo container and/or storage modules may also include various other features such as forklift openings and/or pockets, wheels, casters, shelves, racks, drawers, water stops, door stops, and shock-absorbing pads. The invention also relates to a method of efficiently packing and indexing the equipment and supplies of a military unit into certain storage modules and cargo containers.

BRIEF DESCRIPTION OF THE DRAWINGS

The invention will now be described with reference to the drawings wherein numerals have been used to identify similar features in each of the following figures ("FIGS."), and wherein:

FIG. 1 is an isometric view of one embodiment of a transport and storage device with the doors open and storage modules positioned inside the cargo container;

FIG. 2 is an isometric view of the device shown in FIG. 1 with the storage modules removed from the cargo container;

DETAILED DESCRIPTION OF THE PREFERRED EMBODIMENTS

Figures 36, 37:
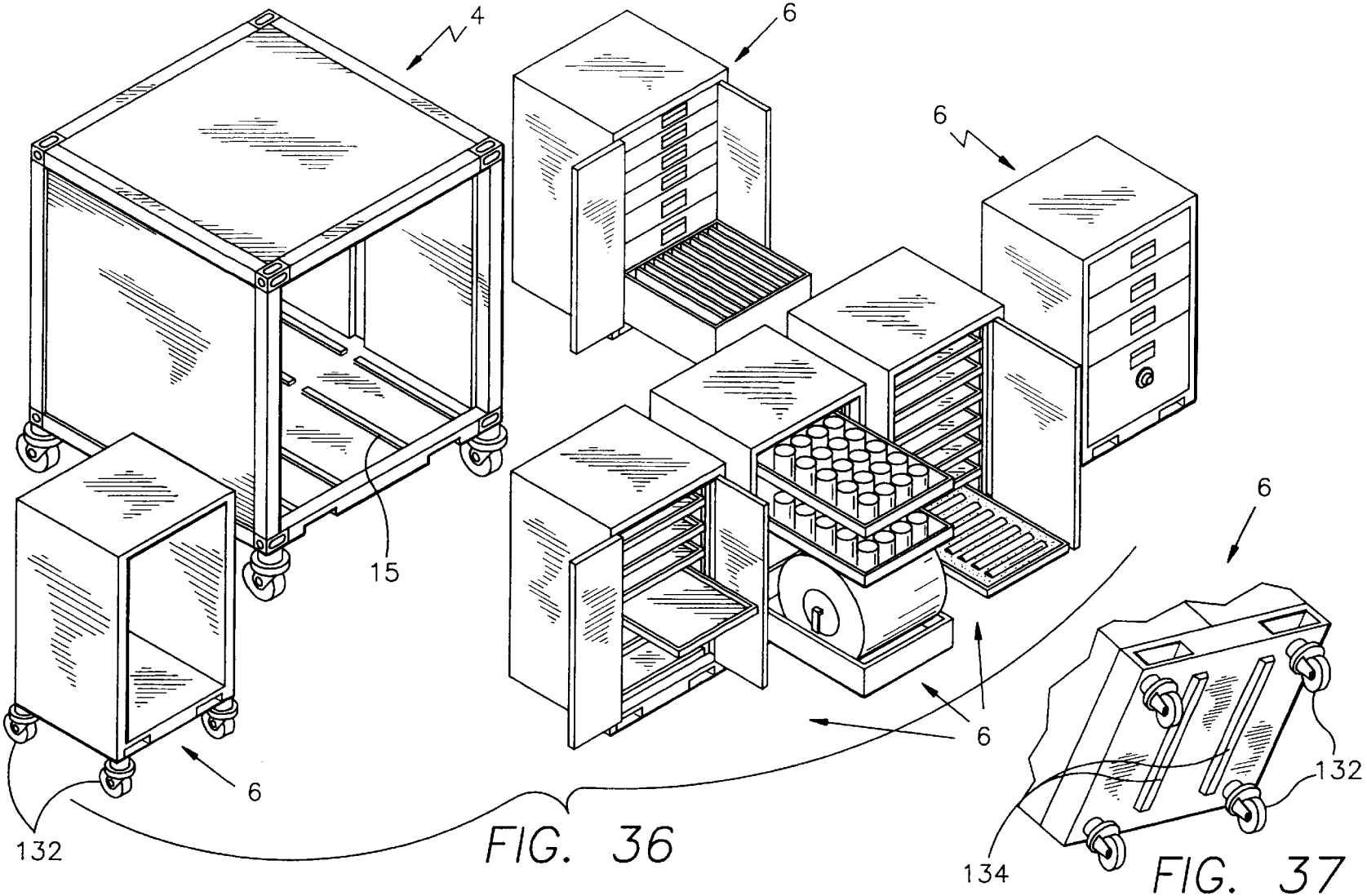
FIG. 36 is an isometric view of the device shown in FIG. 34 with the doors open, and storage modules removed and arranged with other storage modules.
FIG. 37 is a bottom partial isometric view of a storage module in FIG. 36.

FIG. 1 illustrates one embodiment of a transport and storage device 2. The device 2 includes a cargo container 4 with multiple compartments containing a variety of storage modules 6, as shown in FIGS. 1 and 36. Although the storage modules 6 are illustrated here as cabinets with doors and/or shelves, a variety of other storage module devices, such as chests, boxes, racks, closets, and/or armoires may also be used with the container 4. The storage modules 6 may also take the form of various habitability modules, such as offices, kitchens, armories, or decontamination stations.

The storage modules 6 allow various types of cargo to be segregated into different components in the container 4. Cargo can also be further segregated in the drawers or shelves of any one particular storage module 6 and/or by dividers inside those drawers. Furthermore the storage modules 6 may be designed to hold a particular type and/or size of cargo. For example, certain storage modules 6 may be used to contain hazardous materials or bulky items while other storage modules contain non-hazardous materials or less bulky items.

The cargo container 4 may have various dimensions which preferably comply with International Standard ISO 668, Type 1 C ("Series 1 Freight Container-Classification, Dimensions and Ratings"). FIG. 2 illustrates a nominal 8 ft×8 ft by 20 ft cargo container 4, while FIG. 36 illustrates a nominal 8 ft×7 ft×7 ft cargo container. The containers 4 may also be provided with various ancillary features such as environmental controls, wiring, lighting, plumbing, and/or hazardous materials containment facilities. In this way, the cargo containers 4 may also be used for other purposes when the storage modules 6 are removed.

Figure 3:
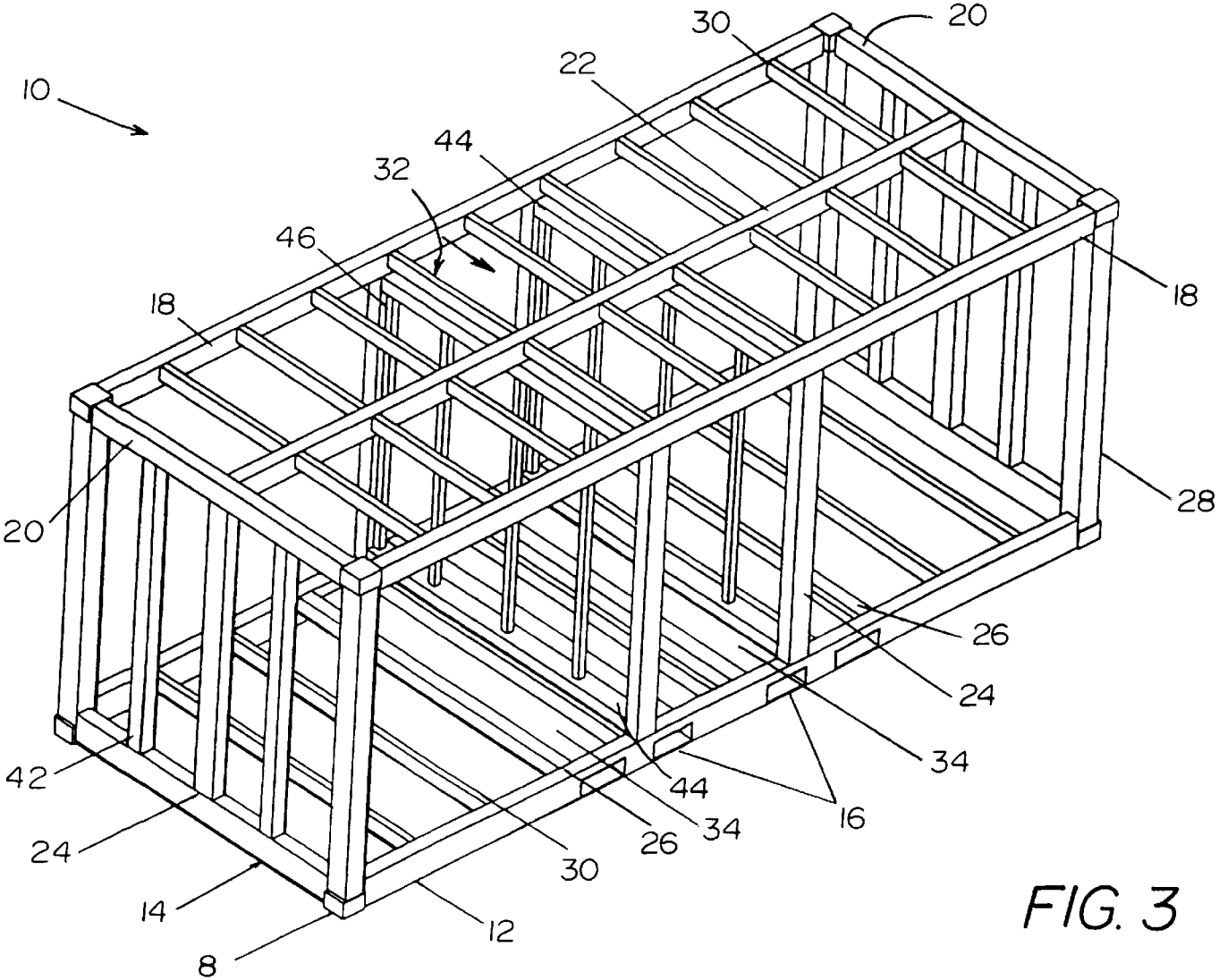
FIG. 3 is an isometric view of one embodiment of a frame assembly for a cargo container.

The cargo container 4 is preferably formed on a frame assembly 10, such as the tubular steel box frame illustrated in FIG. 3. Several panels, preferably ten gauge cold-rolled steel panels, are then secured to the frame in order to form the roof, floor, and ends. Other materials such as corrosion-resistant steel, aluminum and other metals, and plastic, fiberglass, wood, and/or composite materials may also be used. The cargo container 4 may also be used with removable outer panels or with just a frame and no outer panels. In an alternative embodiment, panels may be secured to both sides of the frame in order to provide a double-walled structure. The walls may also be insulated.

Corner fittings 8 are arranged on each of the corners of the frame assembly 10 as shown in FIG. 3, preferably in compliance with ISO 1161 "Series 1 Freight Containers—Corner Fittings—Specification." The corner fittings 8 may be used to lift, stack, secure, and/or join together the cargo containers 4 as is well known in the art. For example, U.S. Pat. Nos. 5,785,591, 5,735,639, and 5,511,908 show various framed structures with similar corner fittings. Lifting rings such as those disclosed in U.S. Invention Registration No. H1477 may also be used. Several of these patents also discuss containment pans that may be used with a cargo container 4.

As discussed in more detail below, the cargo container 4 is preferably provided with one or more doors 11 on at least one side of the container, as shown in FIG. 2. Additional doors are preferably provided on the opposite side of the cargo container 4 for accessing additional storage modules (not shown in FIGS. 1 and 2). Additional doors may also be provided on the ends, top, and/or bottom of the container 4. Although the cargo container 4 shown in FIGS. 1 and 2 is illustrated with two pairs of double doors on two of the compartments, and one single door on the other compartment, other combinations of double and/or single doors, with fewer or more compartments, may also be used. Other smaller doors or hatches may also be provided for inspecting the contents of the container 4.

The doors 11 are arranged in a side-load, longitudinal access, multiple door configuration on each side of the cargo container 4. This configuration allows the entire length of each side of the unit to be opened so that multiple forklifts can be used to load the storage modules 6 in the cargo container 4. The doors 11 are preferably arranged to pivot on, and translate in and out of, the container 4 as illustrated by the arrows shown in FIG. 2 with the aid of one or more tracks 13, or other moveable door supports, as discussed in more detail below. This configuration allows the doors to be fully retracted inside the container so that they are not damaged by the forklift and/or storage modules 6 while the cargo container 4 is being loaded and unloaded. In addition, the inside of the container 4 is preferably provided with receptacles 15, or other means for positioning the storage modules inside the cargo container 4, which are also discussed in more detail below. Finally, the cargo container 4 is preferably provided with various forklift openings 16 in the frame assembly 10 for allowing the container 4 to be transported by conventional or specialized forklifts.

FIG. 3 is an isometric view of one embodiment of a frame assembly 10 for use with the transport and storage device in FIGS. 1 and 2. The box frame assembly 10 shown in FIG. 3 includes a top or roof frame, a bottom or floor frame, two side or side wall frames, two end or end wall frames, and two internal wall frames which will now be discussed in terms of their various structural members, many of which are shared by two or more of these frames. For example, bottom side members 12 and end side members 14 are shared by the floor, side and end frames, and are preferably formed from 8"×4"×¼" rectangular tubing. The bottom side members 12 include forklift pocket openings 16 for accommodating forklifts of various sizes. The outer set of forklift openings 16 provides added lifting stability when the container 4 is heavily loaded.

The top side members 18, top end members 20 and the intermediate upright members 24 are preferably 6"×4"×¼" rectangular tubing. The intermediate top member 22 is preferably 6"×4"×¼" rectangular tubing. The intermediate upright members 24 form part of the internal wall frame 32 described in more detail with respect to FIGS. 10 and 11. The intermediate upright member 24 at each end of the frame assembly 10, corner upright members 28 (which are preferably 6"×6"×¼" square tubing), the end wall upright members 42 (illustrated as 4"×4"×¼" square tubing) form the end walls which are discussed in more detail with regard to FIGS. 8 and 9. The top and bottom cross members 30 are preferably 4"×2"×¼" and 4"×2"×11 gauge rectangular tubing, respectively. The larger bottom cross members 26 are preferably 6"×4"×¼" rectangular tubing. The larger bottom cross members 26 provide additional support near the four forklift pockets 34 which are preferably formed from ¼" plate and extend along the width of the bottom of the frame 10 from forklift pocket openings 16 on each side of the frame. Other structural members besides tubing may also be used to form each of the frame members in the frame assembly 10.

Figure 4:
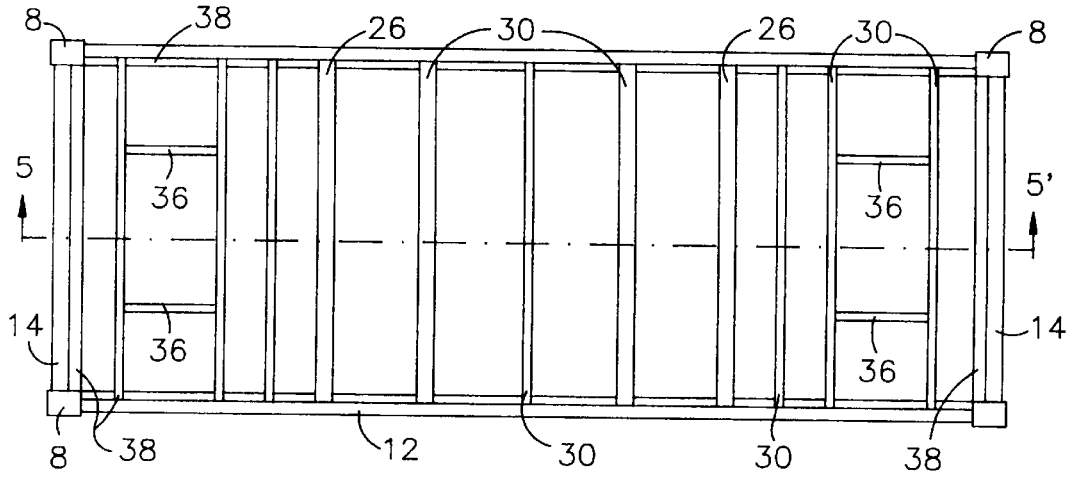
FIG. 4 is a plan view of an alternative floor frame for use with the frame assembly shown in FIG. 3.
Figure 5:
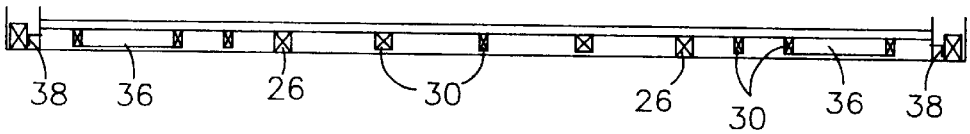
FIG. 5 is a sectional view taken along section line 5–5' in FIG. 4.

FIG. 4 is a plan view of an alternative floor frame for use with the frame assembly 10 shown in FIG. 3, while FIG. 5 is a sectional view taken along section line 5–5' in FIG. 4. In FIGS. 4 and 5, the forklift pockets 34 have been removed for the sake of clarity and two of the bottom cross members 30 have been strengthened with 4"×2"×¼" rectangular tubing braces 36. However, the braces 36 are optional. In addition, 2"×2"×⅛" angles 38 have been secured to the inside of each bottom end member 14 and bottom side member 12 for additional strength. Alternatively, the angles 38 may be provided on either one of the pair of side members 12 or the pair of end members 14.

Figure 6:
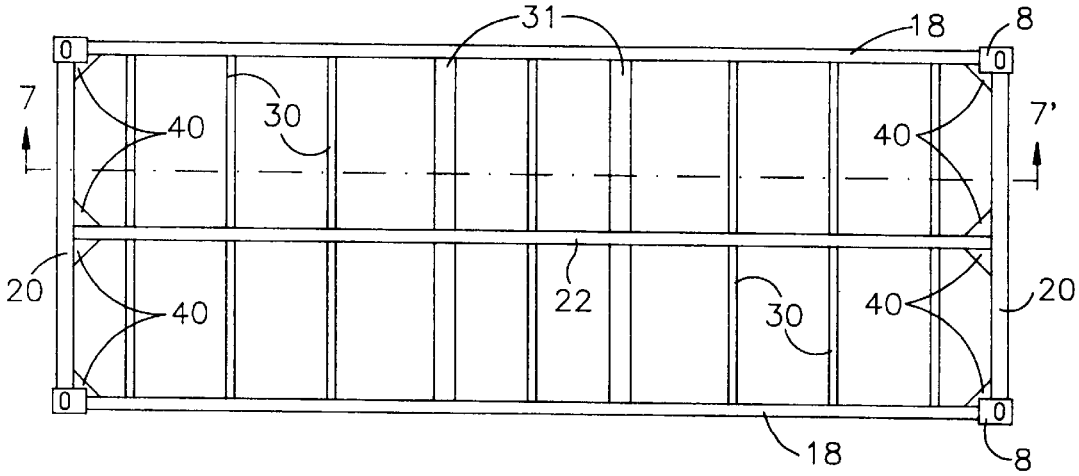
FIG. 6 is a plan view of an alternative roof frame for use with the frame assembly shown in FIG. 3.
Figure 7:
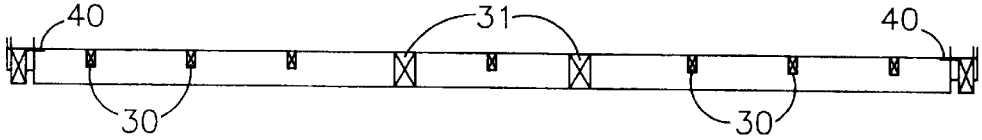
FIG. 7 is a sectional view taken along section line 7–7' in FIG. 6.

FIG. 6 is a plan view of an alternative roof frame for use with the frame assembly 10 shown in FIG. 3, while FIG. 7 is a sectional view taken along section line 7–7' in FIG. 6. In FIGS. 6 and 7, the corners have been strengthened with 6"×6"×ten gauge gusset plates 40 and two of the top cross members 30 have been replaced with larger top cross members 31 which are preferably 6"×4"×3/16" rectangular tubing. As discussed in more detail below, the larger top cross members 31 are preferably vertically aligned with corresponding bottom cross members 30 for supporting the internal walls 32.

Figure 8:
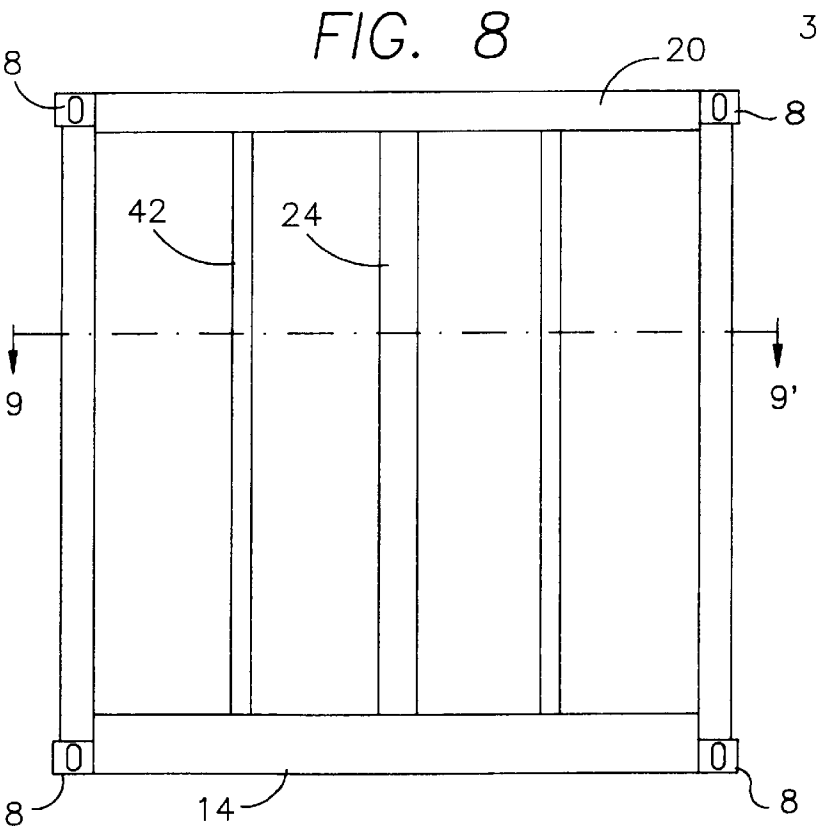
FIG. 8 is an elevational view of an end wall frame for use with the frame assembly shown in FIG. 3.
Figure 9:
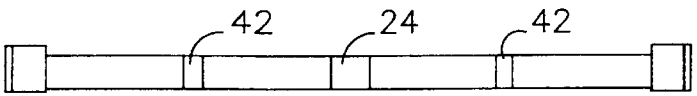
FIG. 9 is a sectional view taken along section line 9–9' in FIG. 8.

FIG. 8 is an elevational view of an alternative end frame for use with the frame assembly shown in FIG. 3 while FIG. 9 is a sectional view taken along section line 9–9' in FIG. 8. In FIGS. 8 and 9, the end wall upright members 42 are 4"×2"× eleven gauge tubing. Gusset plates 40 and/or other stiffeners may also be provided on the end and/or floor frames shown in FIGS. 8 and 4.

Figure 10:
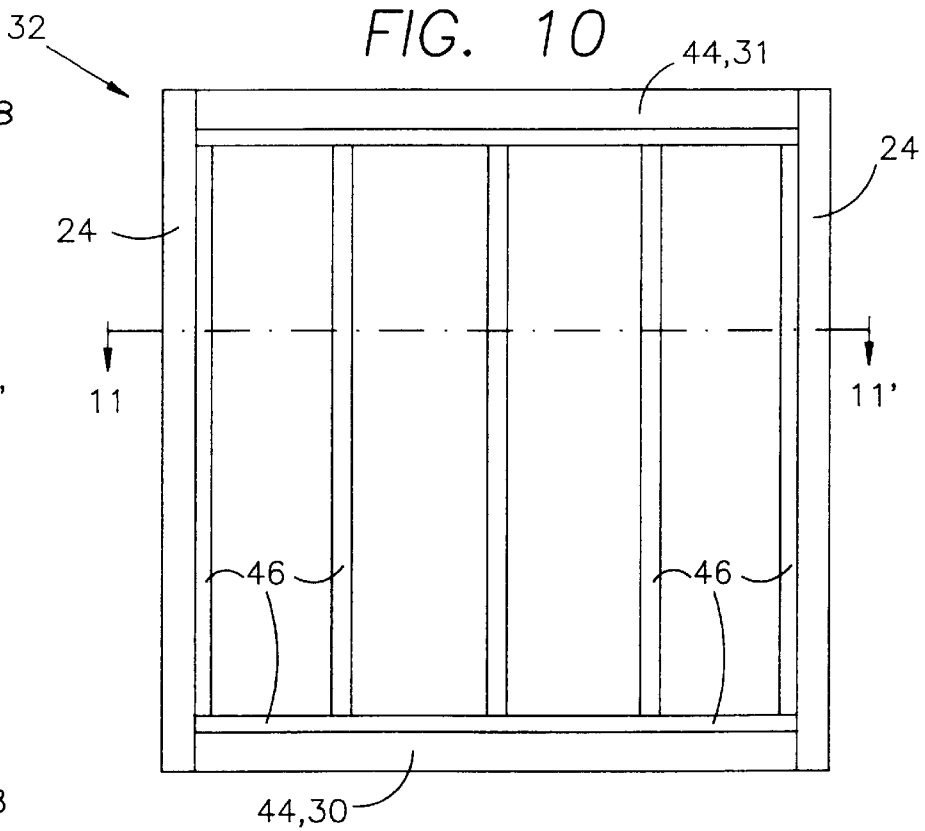
FIG. 10 is an elevational view of an intermediate wall frame for use with the frame assembly shown in FIG. 3.
Figure 11:
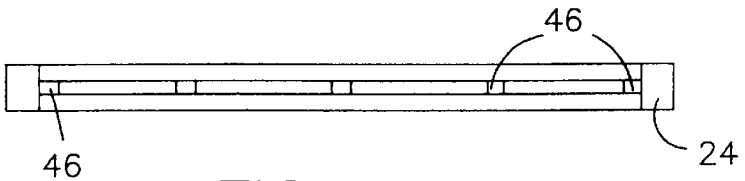
FIG. 11 is a sectional view taken along section line 11–11' in FIG. 10.

FIG. 10 is an elevational view of an internal wall frame 32 for use with the frame assembly 10 shown in FIG. 3 or the alternative top and bottom frames shown in FIGS. 4–7. FIG. 11 is a sectional view taken along section line 11–11' in FIG. 10. When used with the frame assembly 10 shown in FIG. 3, the top members labeled 44, 31 and bottom members labeled 44, 30 correspond to the members 44 shown in FIG. 3 and are preferably 6"×4"×¼" or 3/16" rectangular tubing. When used with the alternative embodiments for the top and bottom frames shown in FIGS. 4–7, the top members labeled 44, 31 and bottom members labeled 44,30 correspond to members 31 (shown in FIGS. 6 and 7) and members 30 (shown in FIGS. 4 and 5), respectively. In either case, the internal wall 32 includes 2×2×sixteen gauge internal wall upright members 46 for supporting internal wall panels (not shown) on one or both sides of the internal walls 32. The internal walls 32 are preferably permanently welded to the frame assembly 10. However, the internal walls 32 may also be bolted or otherwise removably secured so that they may be removed from the cargo container 4 in order to provide a larger undivided space inside the container 4.

The frame assembly 10 for the container 4 is formed by conventional processes such as welding, riveting, bolting, pinning, and/or adhesive processes. A variety of other structural members, components, and layouts, may also be used with the frame assembly 10. However, the frame components illustrated in FIGS. 4–11 provide excellent strength, ruggedness, and rigidity with minimum weight. The metal surfaces of the frame 10 are preferably cleaned and phosphatized, coated with 5 mils high-solid epoxy primer, and then finished with 5 mils of an olive drab or camouflage topcoat of high-build polyurethane finish. A wide variety of other coatings and/or corrosion resisting materials may also be used in order to minimize maintenance.

The walls of the container 4 may be similarly finished. The walls are preferably formed from steel panels which are secured to the frame by welding, bolting, riveting or other conventional means. The top (roof), and end walls are formed from panels which are placed on the outside of the frame assembly 10, while the bottom wall is placed on the inside of the frame assembly 10 to form the floor of the container. Similar panels may be placed on either or both sides of the internal wall frame 32 in order to form separate compartments inside the container 4. Alternatively, the frame assembly 10 may be used without one or more of the wall panels in order to provide one or more exposed compartments inside the cargo container 4.

Figure 12:
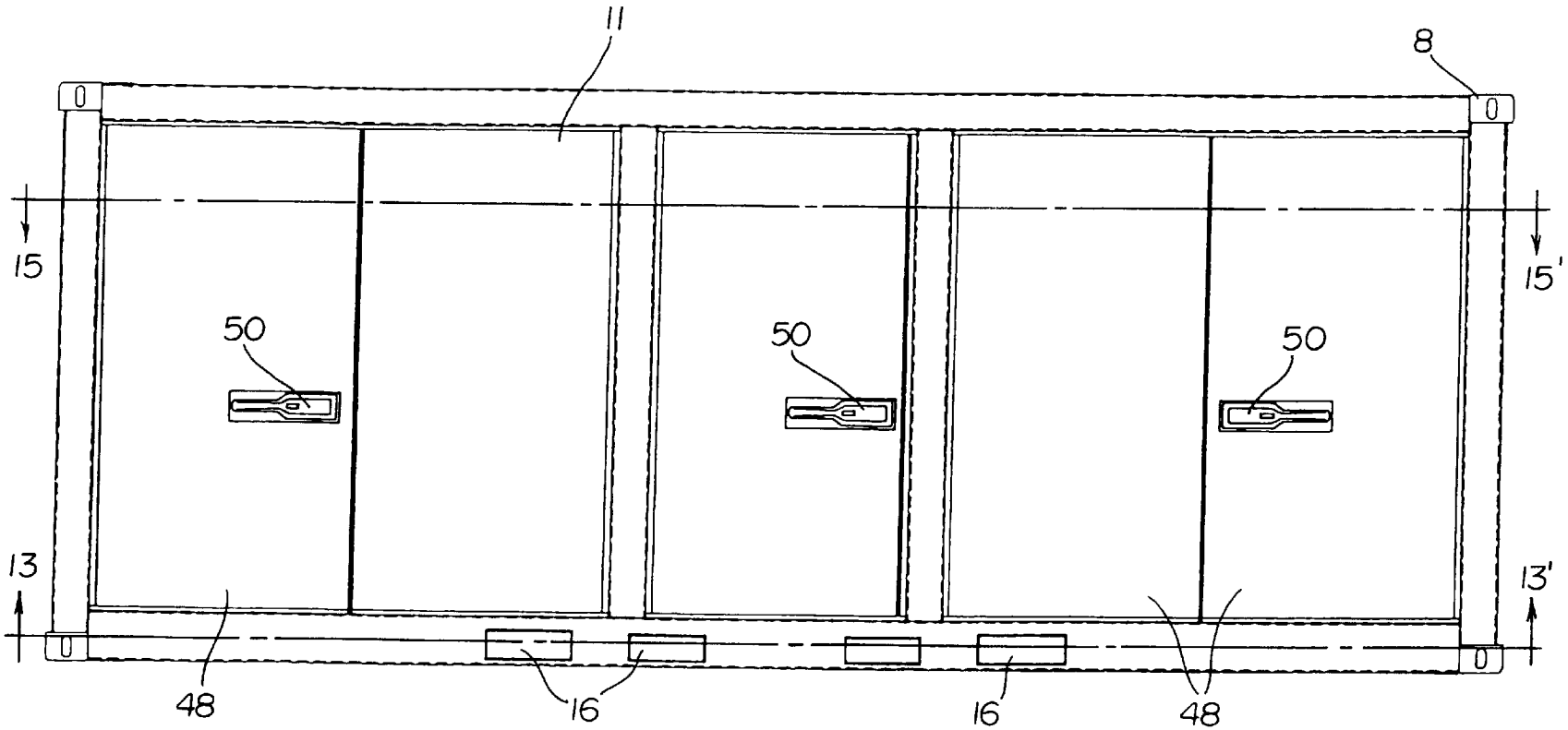
FIG. 12 is a side elevational view of the device shown in FIG. 1 with the container doors closed.

FIG. 12 is a side elevational view of the device shown in FIGS. 1 and 2 with the doors 11 in a closed position. Each of the single doors 11, and at least one of the double doors, is provided with a handle 50 which is preferably connected to a latch mechanism, not shown in FIG. 12. One suitable latch mechanism is a recessed cam-type side door lock with water seal, Part Number 5663, from Eberhard Manufacturing Company of Cleveland, Ohio, shown in FIGS. 63–65. Each door 11 may also be provided with its own handle 50. A variety of other handles, knobs, latches, deadbolts, and/or locking mechanisms may also be used. As discussed below with respect to FIG. 23, the handles 50 are preferably recessed within the door 11.

Figure 13:
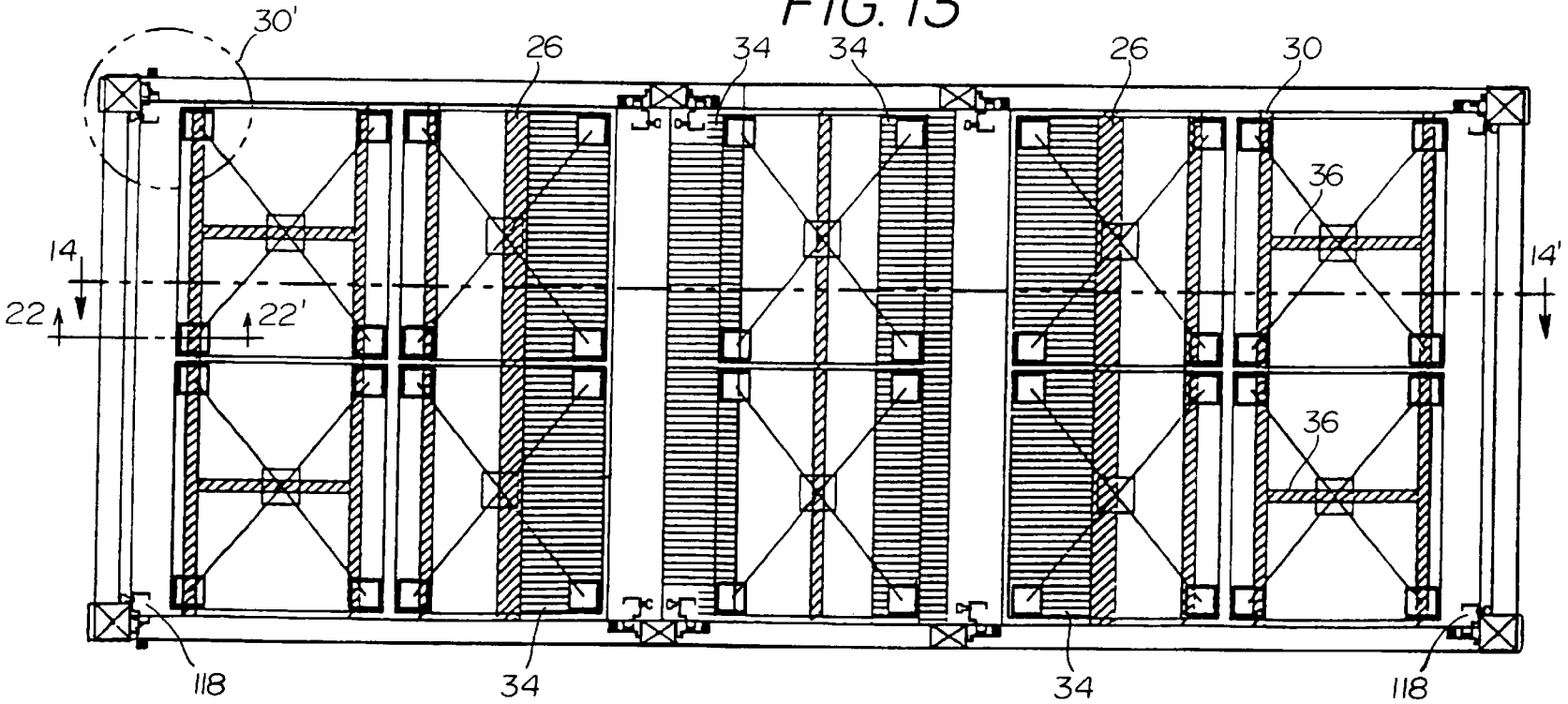
FIG. 13 is a schematic sectional view of an empty cargo container taken along section line 13–13' in FIG. 12.

FIG. 13 is a schematic sectional view taken along section line 13–13' in FIG. 12 with the forklift pockets 34 shown with horizontal cross-hatching and the structural members 26, 30, and 36 shown with diagonal cross-hatching. The large "X"s in FIG. 13 show the positions of base plates which are described in more detail below with respect to FIGS. 15.

Figure 14:
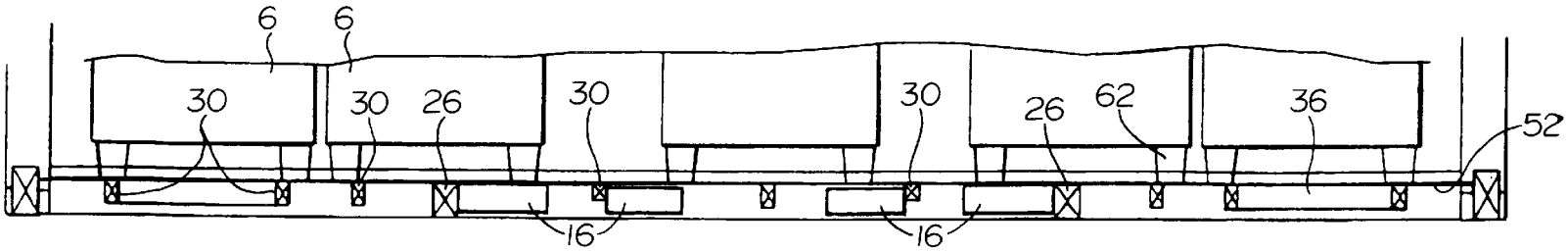
FIG. 14 is a schematic sectional view of a loaded cargo container along section line 14–14' in FIG. 13.
Figure 22:
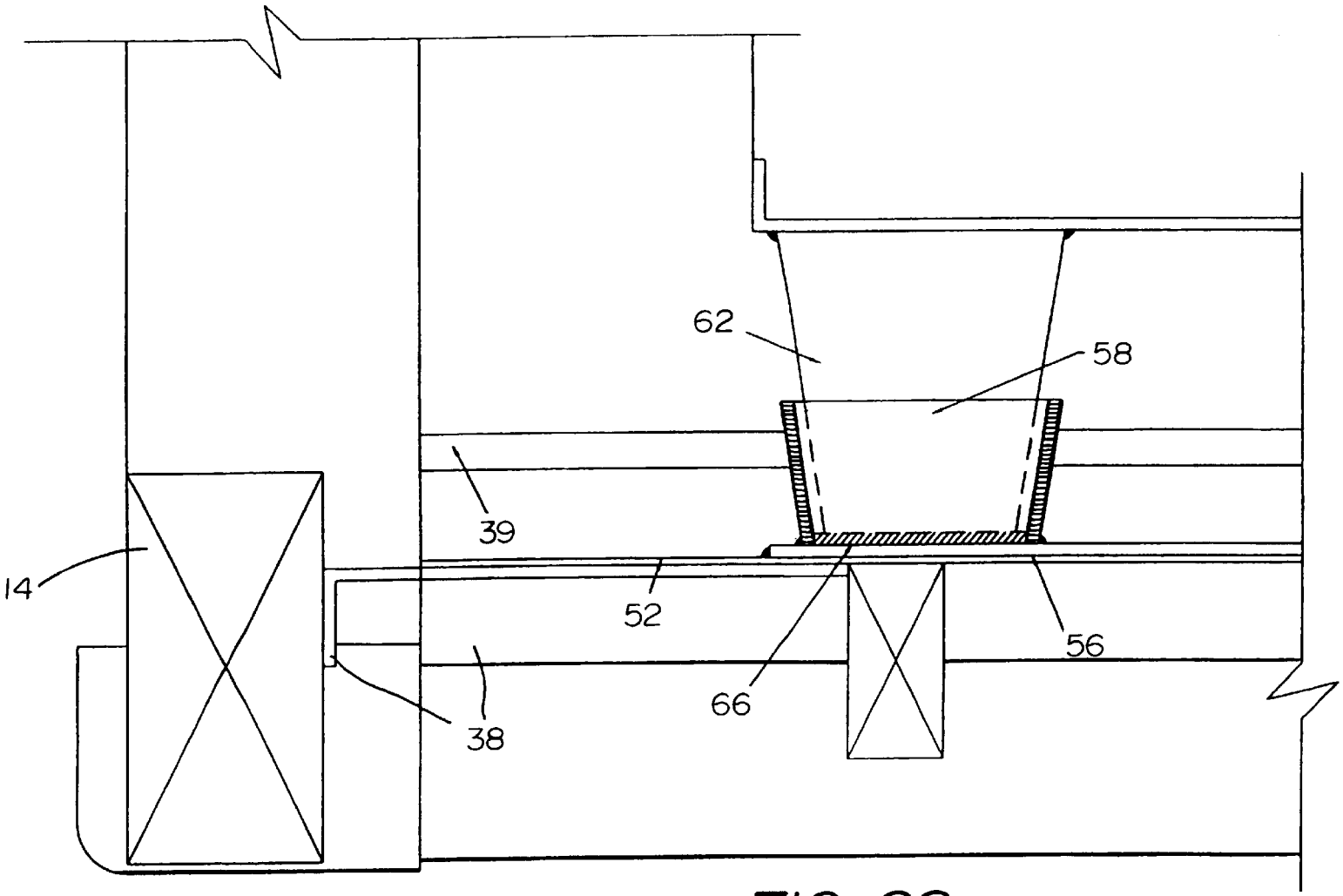
FIG. 22 is a sectional view taken along section line 22–22' in FIG. 13.

FIG. 14 is a schematic sectional view taken along section line 14–14' in FIG. 13, while FIG. 22 is an enlarged sectional view of section 22–22' in FIG. 14. FIGS. 13,14, and 22 illustrates the positioning of the cross members 26 and 30 and the lift pocket openings 16 relative to the feet 62 extending from the base of each storage modules 6. Also shown with respect to FIGS. 12 and 14, two storage modules 6 are positioned behind each of the double doors 11 and a single module 6 is positioned behind each of the single door. Alternatively, a single larger storage module could be used instead of two smaller storage modules 6. As is also shown in FIG. 13, the optional braces 36 extend between bottom cross members 30 at approximately the center of the outer storage modules 6. As shown in FIG. 22, a ¾" door stopper 39 may also be provided.

Figure 15:
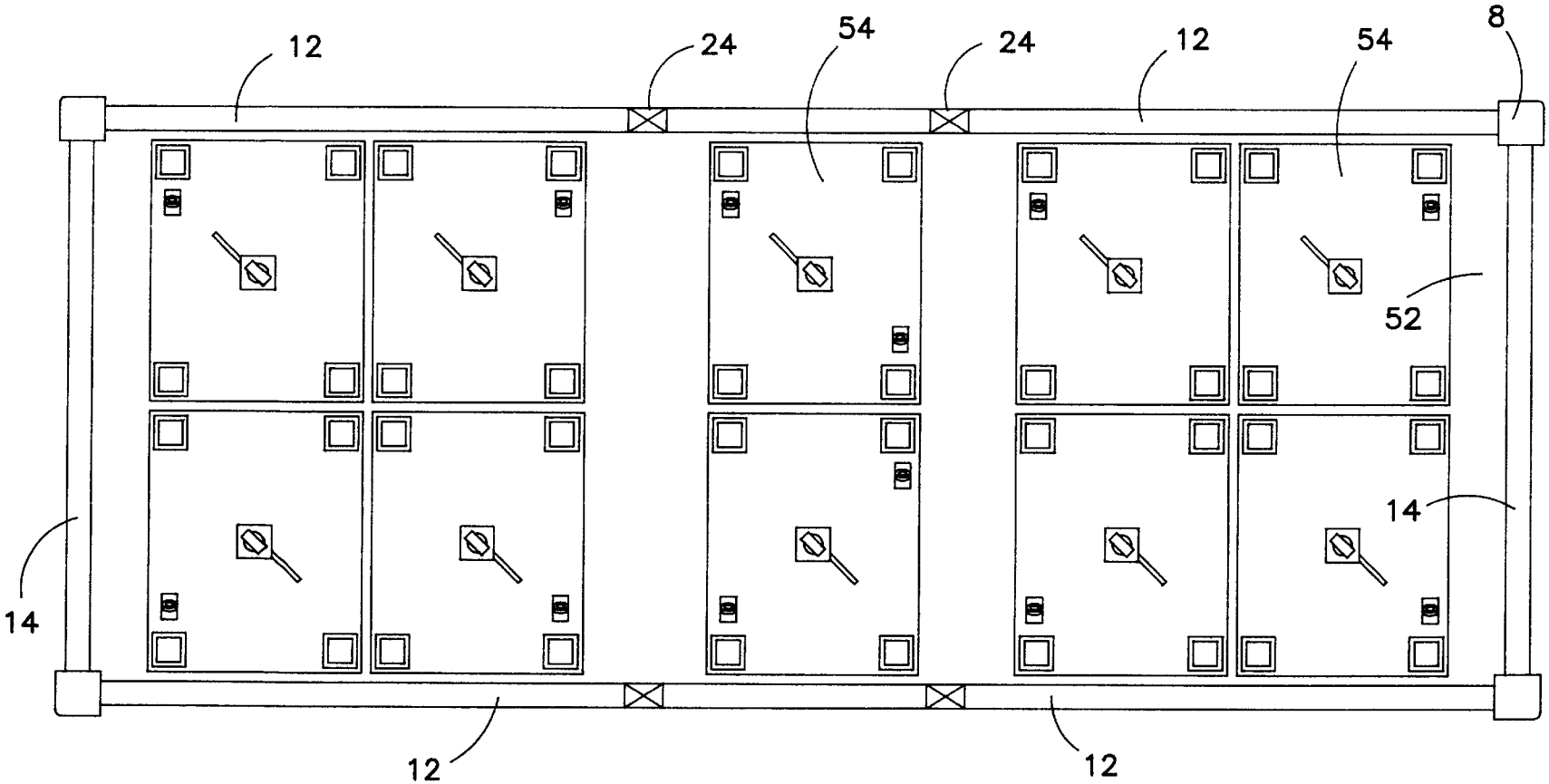
FIG. 15 is a top plan view of the inside of empty cargo container taken along section line 15–15' in FIG. 12.

FIG. 15 is a schematic sectional view taken along section line 15–15' in FIG. 12 showing the general layout of base plate assemblies 54 on a floor 52 arranged on the floor frame (not shown in FIG. 15) of the cargo container 4. The base plate assemblies may also be secured directly to the floor frame itself or the various components of the base plate assemblies may be individually secured to the floor 52 and/or frame assembly 10. However, for the illustrated embodiment, the base plate assemblies are preferably fabricated as a precision unit and then installed inside the cargo container 4 on floor 52.

The arrangement illustrated in FIG. 15 provides for efficient utilization of the space in each of the compartments inside the cargo container 4 and allows two storage modules 6 in the center component to be segregated from the other storage modules. For example, one compartment could be reserved for flammable or otherwise hazardous materials and provided with spill containment facilities, such as a grated floor and containment pan. This arrangement also allows for controlling access to the storage modules 6 from outside the cargo container 4, especially when the modules are in the form of cabinets. Such cabinets may be arranged with their drawers, shelves, and/or racks opening toward the doors 11 of the cargo container 4 for easy access, or with their drawers opening toward the inside of the container for limited access and better security. An endless variety of other base plate arrangements inside the cargo container 4 may also be used depending upon the placement of the doors 11, and the size and shape of the modules 6. Since no aisles are provided between the storage modules 6, space inside the cargo container 4 is more effectively utilized.

Figure 16:
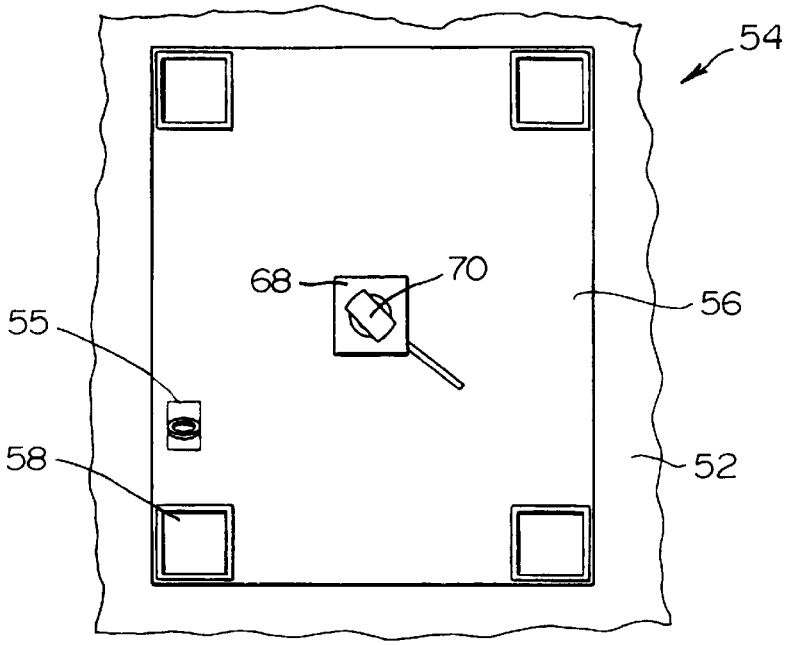
FIG. 16 is an enlarged plan view of one of the base plates shown in FIG. 15.

The base plate assemblies 54 will now be described in more detail with respect to FIGS. 16–22. FIG. 16 is an enlarged plan view of the base plate assembly 54 shown in FIG. 15. The base plate assemblies may be formed by mounting the various components onto a separate base plate 56 which is placed on floor 52, or the components of the assembly can be mounted directly on floor 52 and/or to the frame assembly 10. The base plate assemblies 54 include one or more lashing rings 55 which are preferably formed by a ring assembly and a plate per military requirement 48B7385-3 spec. 57-0-2, type II, Class B. The lashing ring 55 may also be secured directly to the floor 52, the frame assembly 10, or other areas inside the cargo container 4.

The base plate assemblies 54 also include means for positioning at least one removable storage module inside the container and means for releasably securing the storage module to the container. For example, the positioning means may be in the form of a socket, or other receptacle, in the container 4 for receiving at least a portion of the module. The receptacle may also be formed in the storage module 6 for receiving a corresponding portion of the container 4. The receptacle may be a hole formed in the floor of the cargo container 4 in which a least a portion of the bottom of the storage module 6 rests and/or abuts the floor frame. Alternatively, the receptacle may be a hole formed in the storage module 6 for receiving a corresponding protrusion from the cargo container 4. It will be apparent that the various arrangements shown and described prevent substantive motion of the storage module in directions parallel to the floor of the container 4.

The receptacle may also be in the form of an indentation or recess formed in the floor 52 and/or frame assembly 10 of the container 4 which corresponds to the base of the storage module 6. Alternatively, the recess may be formed in the base of the storage module 6 corresponding to a projection from the floor 52 or frame assembly 10. Thus, as shown in FIG. 2, the floor may contain slot-shaped receptacles 15 for receiving corresponding projections from the bottom of the modules 6. The slot-shaped receptacles 15 may also extend through the frame assembly 10 in the front and back sides of the cargo container 4 so that the storage modules 6 may be slid from one side of the cargo container to the other. The slot-shaped receptacles preferably have walls which taper downward in order to guide the corresponding projections on the base of the storage module 6 into the slots as the storage module 6 is lowered into position. Similar slot-shaped receptacles may also be arranged transversely to the slot-shaped receptacles 15 shown in FIG. 2 in order to allow the storage cabinets to be rotated 90 degrees and/or slid in the transverse direction.

Figure 17:
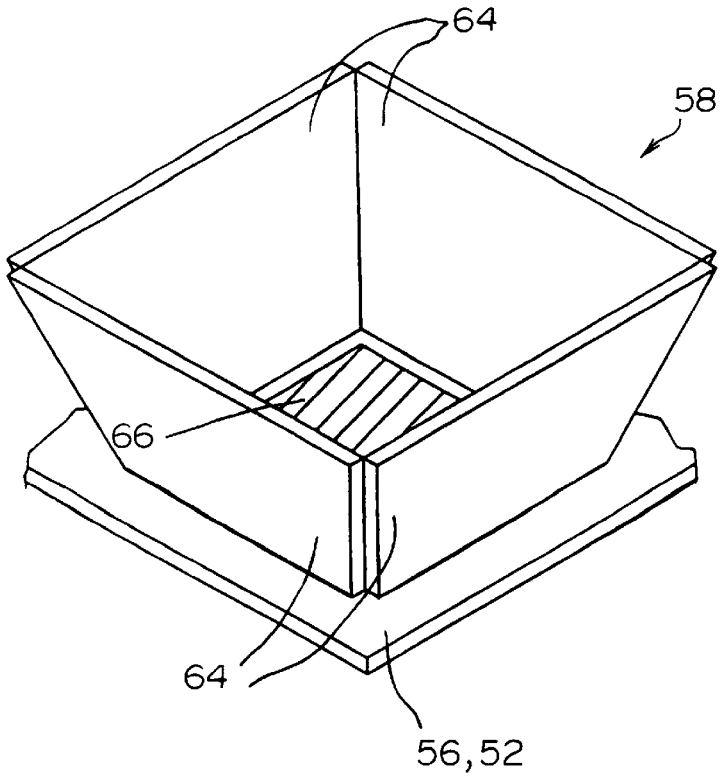
FIG. 17 is an enlarged isometric view of the foot socket shown in FIG. 16.

In a preferred embodiment, the receptacle 58 has walls that extend above the base plate 56 as illustrated in FIGS. 16 and 17. The receptacle 58 receives a foot 62 (see FIG. 14), or other appendage, extending from the storage module 6. The foot receptacle 58 shown in FIG. 17 includes walls 64 which are secured to the base plate 56 and are angled outward away from the base plate in order to help position the module foot 62 as the module 6 is lowered into the foot receptacle 58. The walls 64 of the foot receptacle 58 are preferably formed from ¼" steel plate; however other materials and thicknesses may also be used.

A shock absorbing pad 66, or other cushioning device, is preferably arranged at the bottom of the foot receptacle for cushioning the module 6 as it is lowered into the receptacle. The pad 66 may be formed from neoprene or other suitable elastomeric material, such as rubber or plastic. Alignment indicators, such as markings or sensors, may also be provided to aid in positioning the modules 6 in the container 4.

Although four walls 64 are illustrated for the receptacle 58 shown in FIG. 17, any other number of walls may also be used. For example, each of the foot receptacles 58 shown in FIG. 16 may include just one wall positioned on a different side for each of the corresponding foot positions. One large receptacle surrounding at least a portion of the base of one or more modules 6 may also be used. Although FIG. 16 illustrates four receptacles on each of the corners of the base plate, a different number of receptacles and/or a different arrangement of receptacles on the base plate may also be used.

The receptacles, including any holes, recesses, indentations, and/or sockets for receiving at least a portion of at least one of the storage modules 6 may also be arranged on other inside surfaces of the cargo container 4. In addition, the receptacles may be in a variety of shapes and/or locations corresponding to the modules 6. However, shapes with tapered or slanting interior surfaces, or other guiding features, that are arranged on the floor are generally preferred for helping to align the modules 6 as they are typically lowered into position in the container 4.

Figure 18:
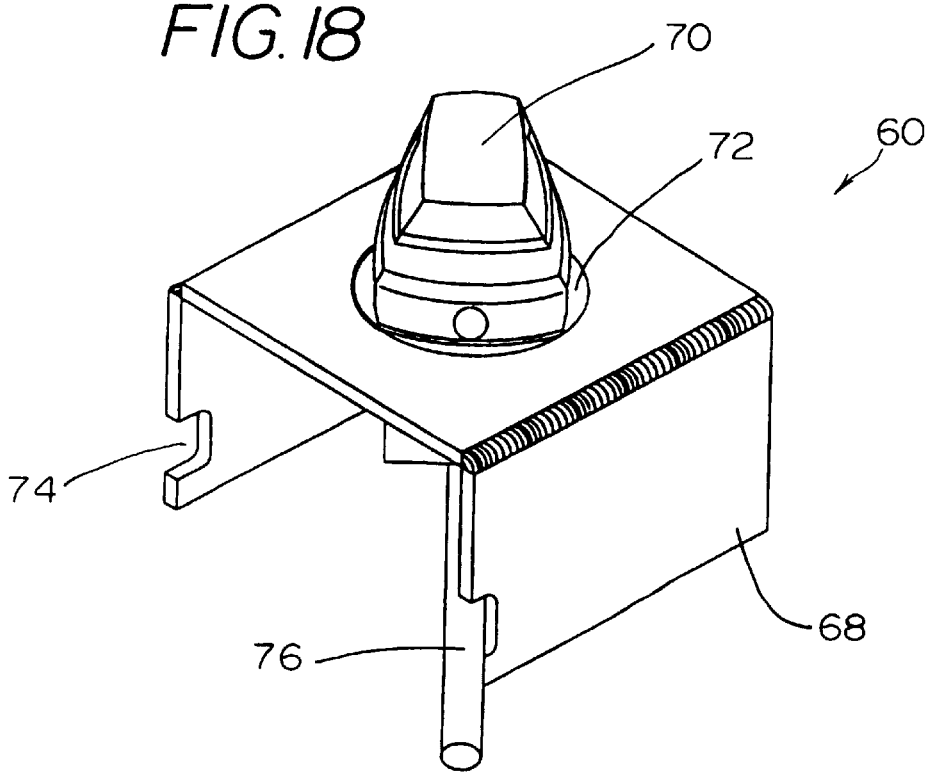
FIG. 18 is an enlarged isometric view of a container securing fitting mounted in a floor bracket.

FIG. 18 is an enlarged isometric view of the module securing assembly 60 which is preferably attached to the base plate 56 on the floor of the cargo container 4. However, the module securing assembly may be attached to the inside of cargo container 4 in other locations, such as to the frame assembly 10 or to the floor panel 52. The assembly 60 includes a container bracket 68 and a container securing fitting 70 which is preferably welded, or otherwise fixed, to the to the container bracket 68. The container bracket 68 in FIG. 18 is shown with a round mounting hole 72 for receiving the corresponding circular body of the container securing fitting 70 before the fitting 70 and the bracket 68 are welded together. However, the container securing fitting 70 may also be removable from the container bracket 68 for use with other floor brackets and, if suitably sized, corner fittings 8.

Arm notches 74 are also provided for accommodating the rotational movement of the arm 76 on the container securing fitting 70 as discussed in more detail below with regard to FIGS. 20 and 21. Suitable container securing fittings are available from Tandem Lock, Inc., of Havelock, N.C. Tandem Lock's straight handle twist lock steel, painted, Part No. S38000B-1 PA is illustrated in the figures; however a variety of other securing fittings may also be used. Various other quick-release securing mechanisms could also be used with appropriate modification of the brackets disclosed here. The container securing fitting 70 may also be provided with a locking mechanism.

Figure 19:
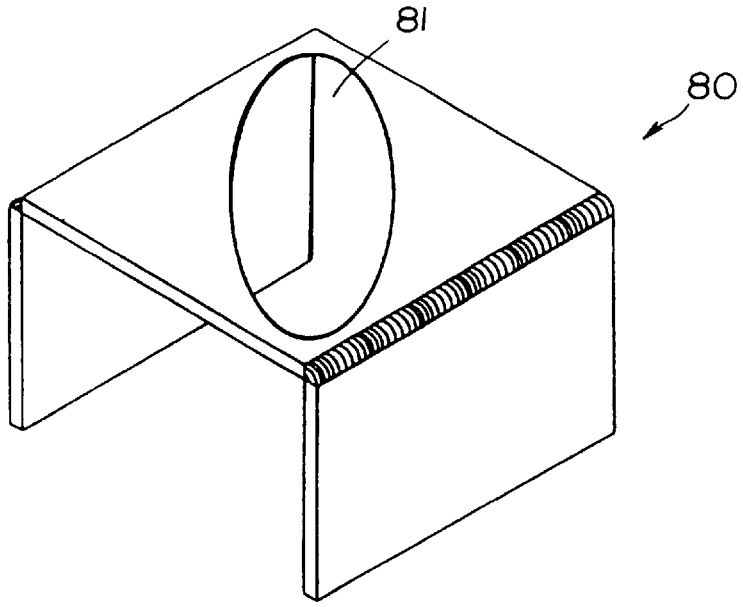
FIG. 19 is an enlarged isometric view of a storage module bracket for engaging with the container securing fitting shown in FIG. 18.

FIG. 19 is an enlarged isometric view of a storage module bracket 80 for engaging the top portion, or "head," of the container securing fitting 70. The module bracket includes an elliptical opening for receiving the corresponding top portion of the container securing fitting 70 when the storage module is being secured. As shown in FIG. 21, the storage module shoulder bracket 80 is secured to the bottom of a storage module 6 in alignment with the container bracket 68. Since the preferred location for the container bracket 68 is on a base plate 56 mounted on the floor 52 of the container 4, the bracket 68 is sometimes referred to as a floor bracket. However, other bracket positions may also be used as long as the elliptical opening 81 in the storage module bracket 80 corresponds to, and is properly aligned with, the generally elliptical head of the container securing fitting 70. The bracket 80 may also be replaced by an elliptical opening in the base of the storage modules 6 by shortening the legs on the storage module and/or raising the height of the floor bracket 68.

Figure 21:
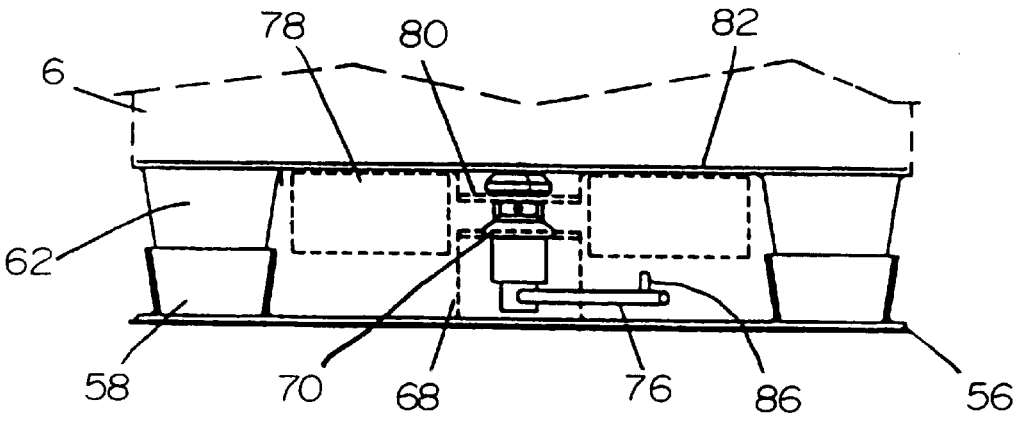
FIG. 21 is a sectional view taken along section line 21–21' in FIG. 20 showing a properly positioned storage module being secured to the container.
Figure 20:
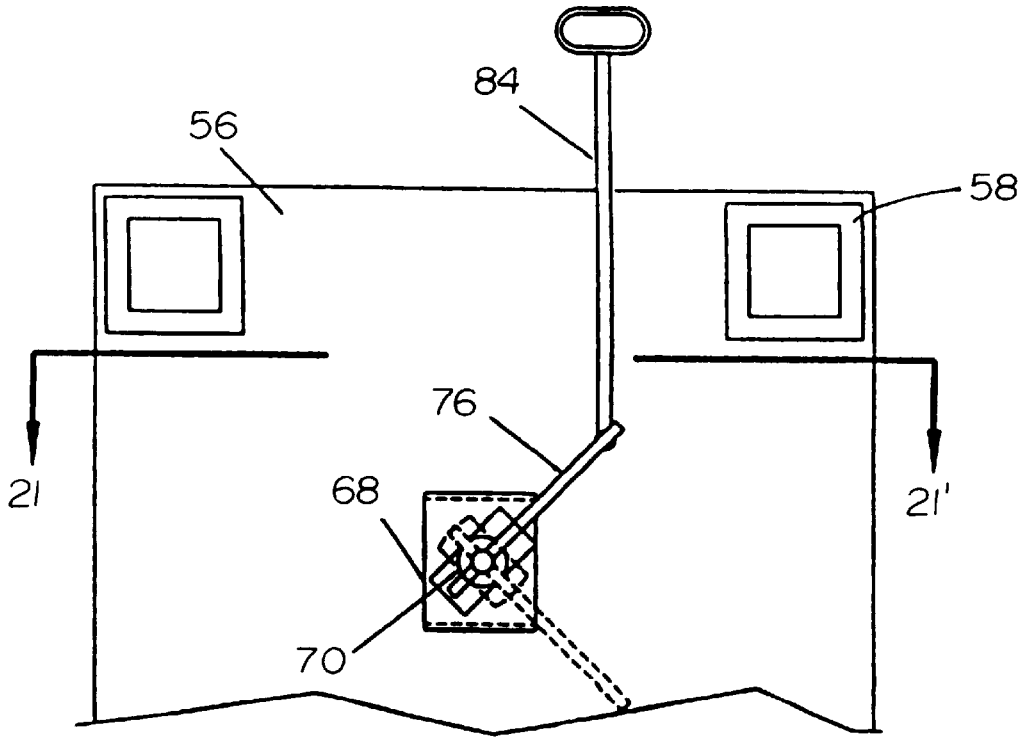
FIG. 20 is a plan view showing the operation of the container securing fitting.

FIGS. 20 and 21 show the operation of the container securing or clamping fitting 70 for releasably securing the bracket 80 on the storage module 6 to the corresponding bracket 68 on the cargo container 4. As shown in FIGS. 21 and 22, the feet 62 of the module 6 have already been lowered into the receptacles 58 using a forklift with forks extending through forklift safe zones 78. As illustrated in FIG. 20, the arm 76 on the container clamping fitting 70 may be easily rotated with the aid of a grab handle 84 which engages a nub 86, or other portion of the handle 76, so as to create an easily accessible extension for the arm 76. Rotation of the handle 76 on the container clamping fitting 70 causes the head of the container clamping fitting to first move vertically through the elliptical hole 81 in the module bracket 80. Once the container clamping fitting 70 is fully extended through the elliptical hole 81, further rotation of the handle 76 caused the head of the fitting 70 to rotate and then to retract so that the bottom side of the head abuts the inside surface of the module bracket 80 and clamps the storage module 6 to the corresponding container bracket 68 on the base plate 56.

FIG. 21 also illustrates how a false floor can be created inside the cargo container 4 by replacing the storage module 6 with just the storage module base plate 82 attached to feet 62. In this configuration, the storage module base plates 82 form a series of false floor tiles which cover the container securing fittings and the floor bracket 68 so as to create a substantially smooth, raised surface on the floor of the cargo container 4. This configuration is particularly useful for conducting ABS testing during which a large balloon is inflated inside the cargo container 4 in order to ensure that the frame assembly 10 and exterior wall panels are structurally sound. The false floor created by base plates 82 and feet 62 prevent the ABS balloon from snagging or puncturing on any of the appurtenances from the base plate 56 that would not be covered if the false floor was not provided.

The door system for the container preferably consists of two pairs of double doors and one single door on each longitudinal side of the cargo container 4 shown in FIG. 1. The doors are preferably hinged on heavy-duty, 3" open, stainless steel continuous hinges which join the door to a transverse sliding mechanism. Each door may be retained in a closed position with a 2-point cam system latch mechanism having recessed handles 50 and padlock, or other locking, capability. The doors are preferably recessed inside the frame assembly 10 in order to prevent damage during transport and tampering during storage. These and other aspects of one embodiment of a door system will now be described with respect to FIGS. 23 through 33.

Figure 23:
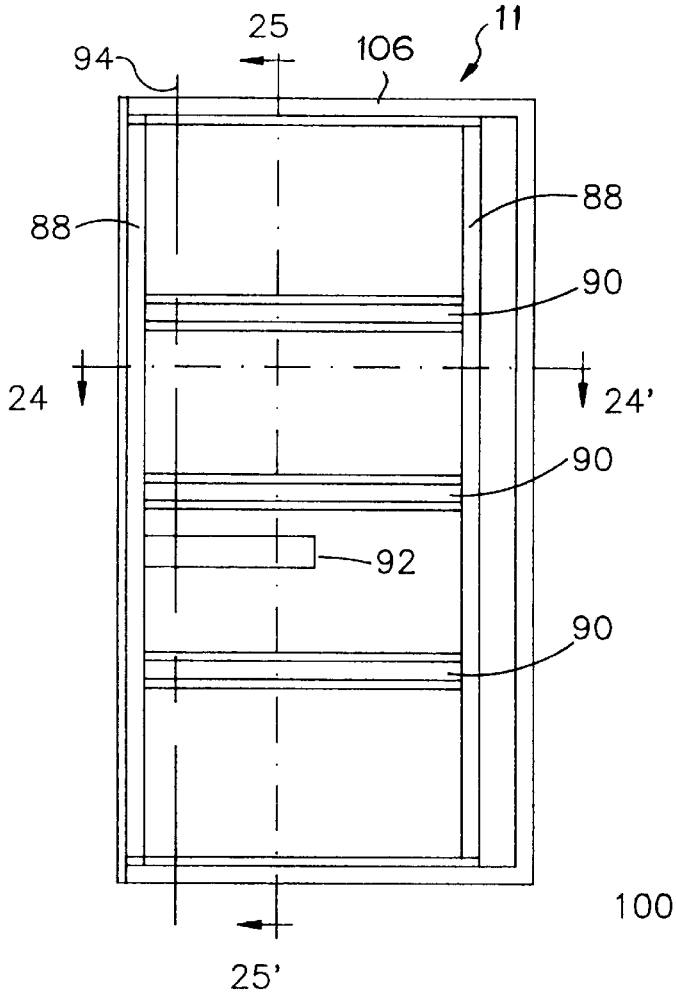
FIG. 23 is an inside elevational view of a door.
Figure 25:
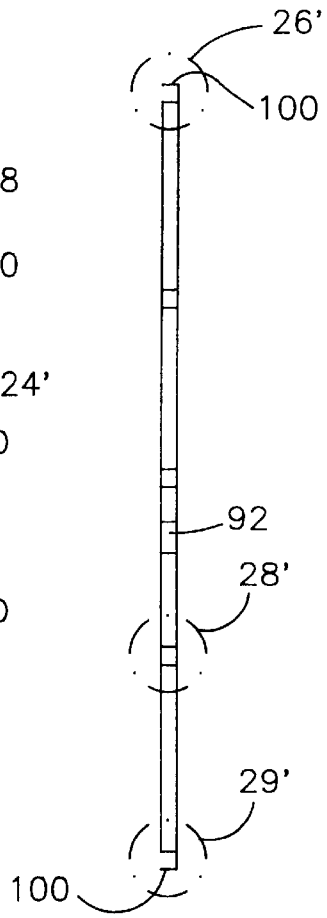
FIG. 25 is a sectional view taken along section line 25–25' in FIG. 23.
Figure 24:
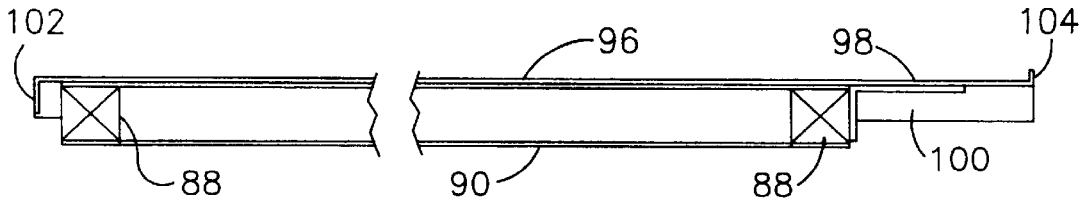
FIG. 24 is a sectional view taken along section line 24–24' in FIG. 23.

FIG. 23 is an inside elevational view of a door 11, while FIGS. 24 and 25 are sectional views taken along section lines 24–24' and 25–25', respectively, in FIG. 23. The edges of the door 11 are stiffened with 1½"×1½"× fourteen gauge edge members 88. Three fourteen gauge formed channel-shaped stiffeners 90 are horizontally secured to the inside surface the door 11. A handle recess 92 extends inward from the front face of the door for containing the handle 50. Centerline 94 shows the position of a linkage pipe (not shown in FIG. 23) which is part of a presently preferred latch mechanism. Details of the door structure in FIG. 23 are shown in FIGS. 24 through 29.

As shown in FIGS. 24 and 25, the door 11 preferably includes a fourteen gauge skin 96, and a ten gauge, L-shaped, hinge plate 98. A water stop flange 100 is arranged around all edges of the door 11. As discussed in more detail below, a first projection 102 is provided on the free edge of the door while a second projection 104 is provided on the hinged edge of the door.

Figure 26:
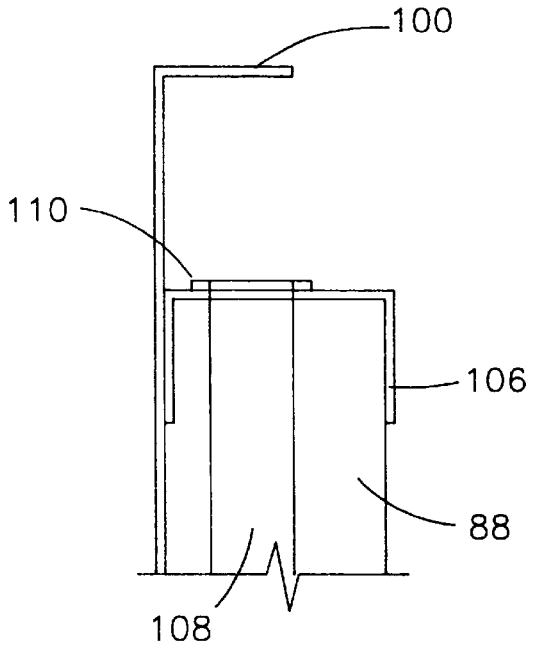
FIG. 26 is a reverse detailed view of area 26' in FIG. 25.
Figure 27:
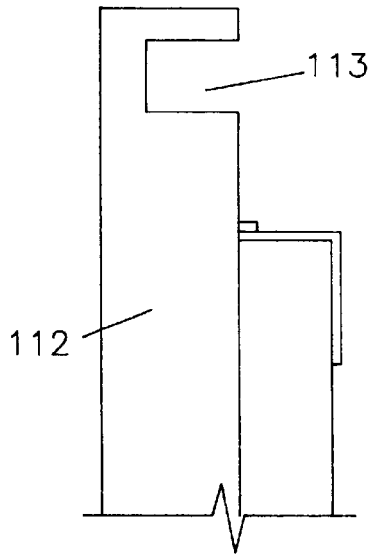
FIG. 27 is a side full view of FIG. 26.

FIG. 26 is a reversed detail view of the top edge area 26' shown in FIG. 25, while FIG. 27 is a full side view of the area in FIG. 26 with the free edge water stop 112 in place on the end of the door 11. As illustrated in FIG. 27, the door edge members 88 are provided with a fourteen gauge door edge stiffener 106. A linkage pipe 108 for a latch mechanism (see FIGS. 63–65) which is connected to handle 50 (not shown in FIG. 26) extends through the stiffener 106. A mounting bracket 110 is provided on the end of the linkage pipe 108 and is connected to a cam keeper (not shown in FIG. 26) which rotates on the end of linkage pipe 108 when the handle 50 is pulled. In this way, the cam keeper 148 can be rotated and retracted through the recess 113 in free edge water stop 112 in order to allow the door 11 to be opened.

Figure 28:
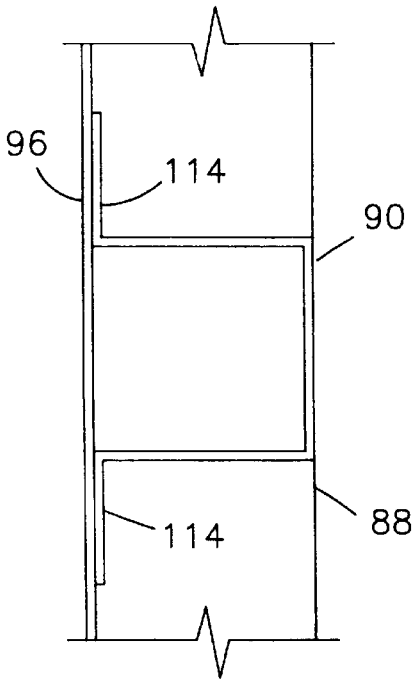
FIG. 28 is a reverse detailed view of area 28' in FIG. 25.
Figure 29:
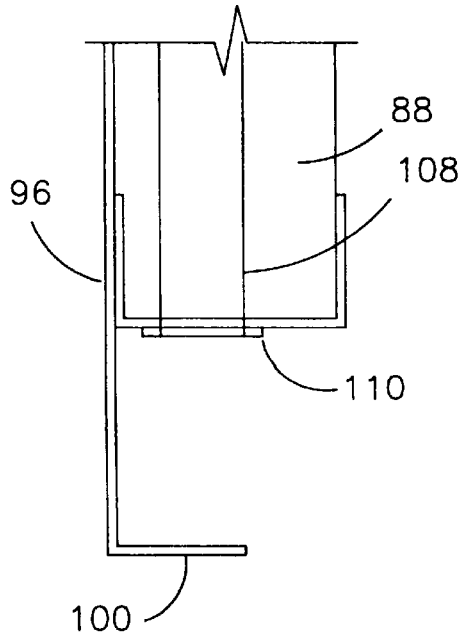
FIG. 29 is a reverse detailed view of area 29' in FIG. 25.

FIG. 28 is a detail view of the channel area 28' shown in FIG. 28. As shown in FIG. 28, the door stiffeners 90 have flanges 114 for securing the door skin 96. The bottom edge sectional detail shown in FIG. 29 is substantially the same as the top edge sectional detail shown in FIG. 27 and illustrates the edge water stop extending around the entire door. Another notch 113 may also be provided near the bottom edge of the free edge water stop 112 for accommodating another cam keeper 148 (not shown in FIG. 28) in the manner described above with regard to FIG. 26.

Figure 30:
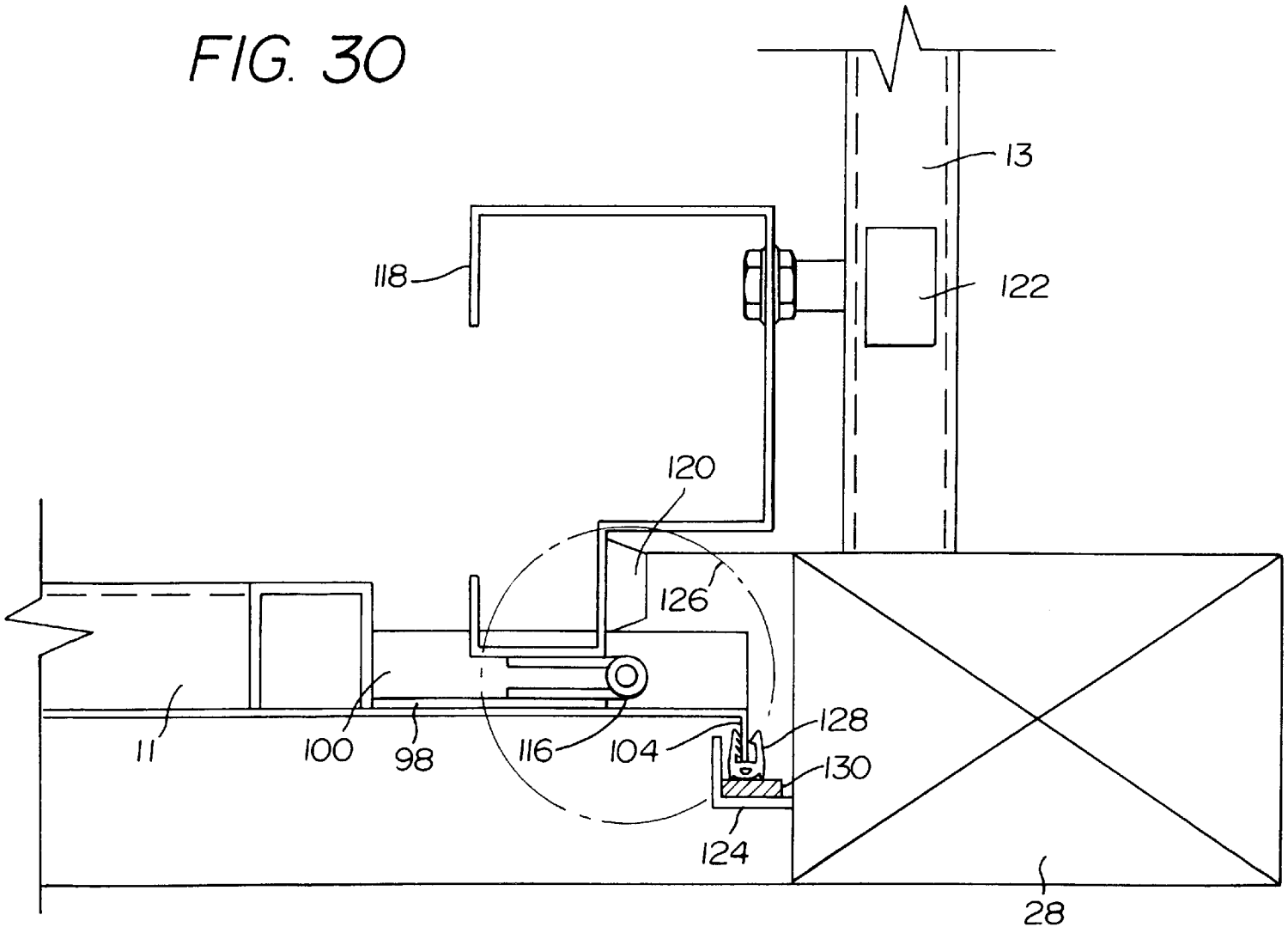
FIG. 30 is a top sectional view of a door support system for the cargo container.

FIG. 30 is a reverse detailed view of area 30' in FIG. 13 showing a support system for the door 11 in a closed position. The hinge 116 is secured to the hinge plate 98 on the door 11 and to a roller bracket 118. The roller bracket 118 and/or door 11 may also be provided with a door stop 120. The roller bracket 118 is fitted with a roller 122 in a track 13 which is discussed in more detail below. However, the roller bracket 118 may also be arranged with a slide that fits into track assembly 13 without a roller. Alternatively, the positions of the roller/slide 124 and track 13 may be reversed.

The corner upright member 28, or other portion of the container 4, is provided with a concave member which is illustrated here in the form of an L-shaped lip 124. The concave lip 124 receives the hinged edge projection 104 when the door is in a closed position. When opened, the tip of the hinged edge projection 104 travels along the path shown by arc 126 until the inside face of the door 11 near the hinged edge of the door abuts the door stop 120. The tip of the hinged edge projection 104 may be provided with weather striping 128 and/or the inside portion of the L-shaped 124 may be provided with a suitable seal 130. With the door 11 swung open, it is free to be slide in and out of the cargo container 4 by movement of the roller 122 along the track 13. In this embodiment, the hinge 116 and the hinged and hinged edge of the door are arranged entirely inside the container 4 in order to prevent tampering with the hinge from outside the container 4 and provide better security.

Figure 31:
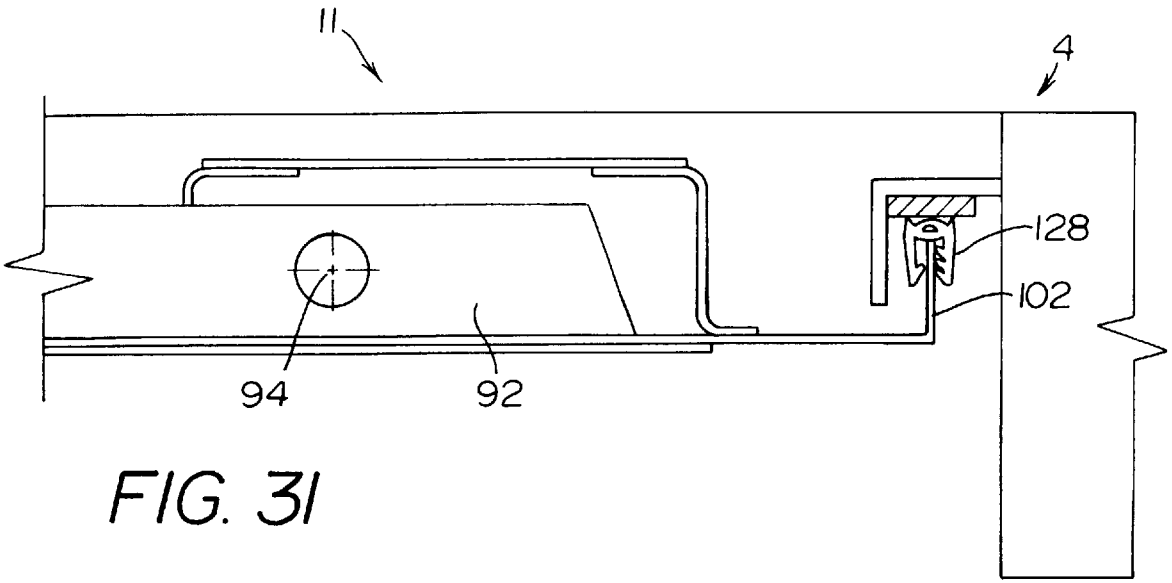
FIG. 31 is a top sectional view of a joint between a free end of a door and a cargo container.
Figure 32:
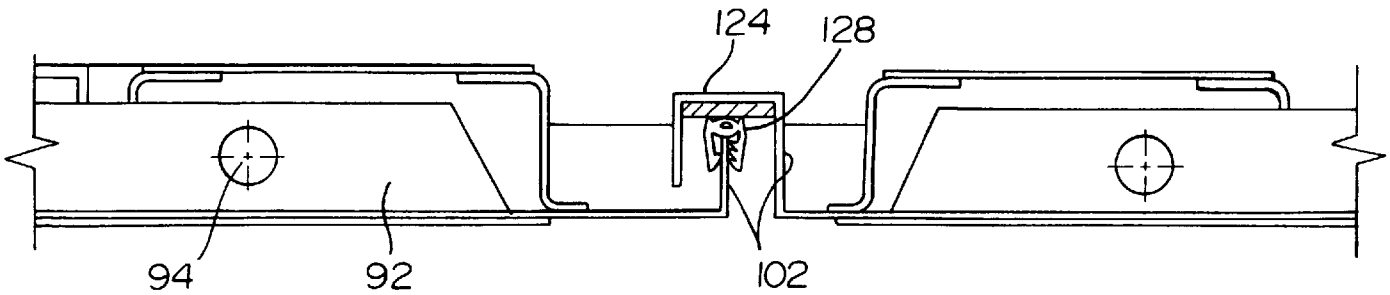
FIG. 32 is a top sectional view of a joint between a pair of doors in a cargo container.

FIG. 31 is a sectional view of a free end of a single door 11 in the closed position while FIG. 32 shows the joint between the free ends of a pair of double doors which are also closed. In these figures, the weather strip 128 is arranged on the tip of the free edge projection 102 (see FIG. 24). For the double door configuration shown in FIG. 32, the free edge projection on one of the doors is provided with a concave and L-shaped lip 124 which receives the projection 102 from the other door. These figures also illustrate an orifice 94 through which the linkage pipe 108 extends from the handle recess 92 toward at least one notch 113 at the top of the door 11 (see FIGS. 23 and 26).

Figure 33:
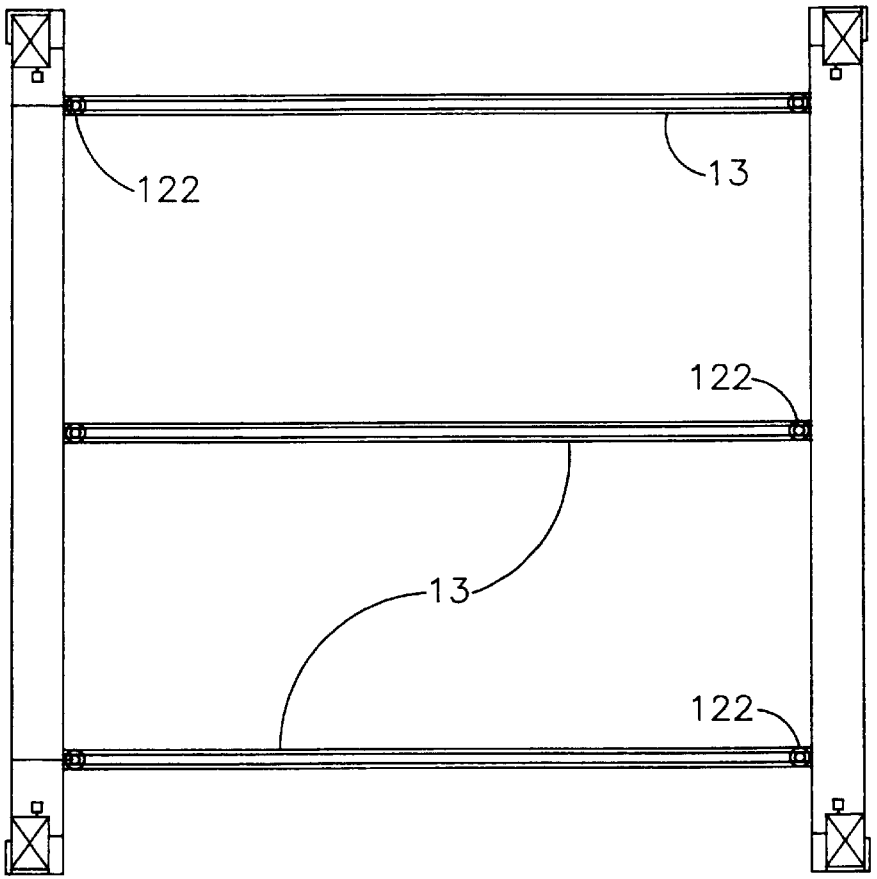
FIG. 33 is an elevational view of a roller track assembly for a door of the cargo container.

FIG. 33 is an elevational view of a roller track assembly for use with the hinge bracket 118 shown in FIG. 30. As shown in FIG. 33, the track assembly may include one or more tracks 13 for accommodating one or more rollers 122, or sliding devices, which allow the doors 11 to transverse inside the container when the doors are open.

Figure 34:
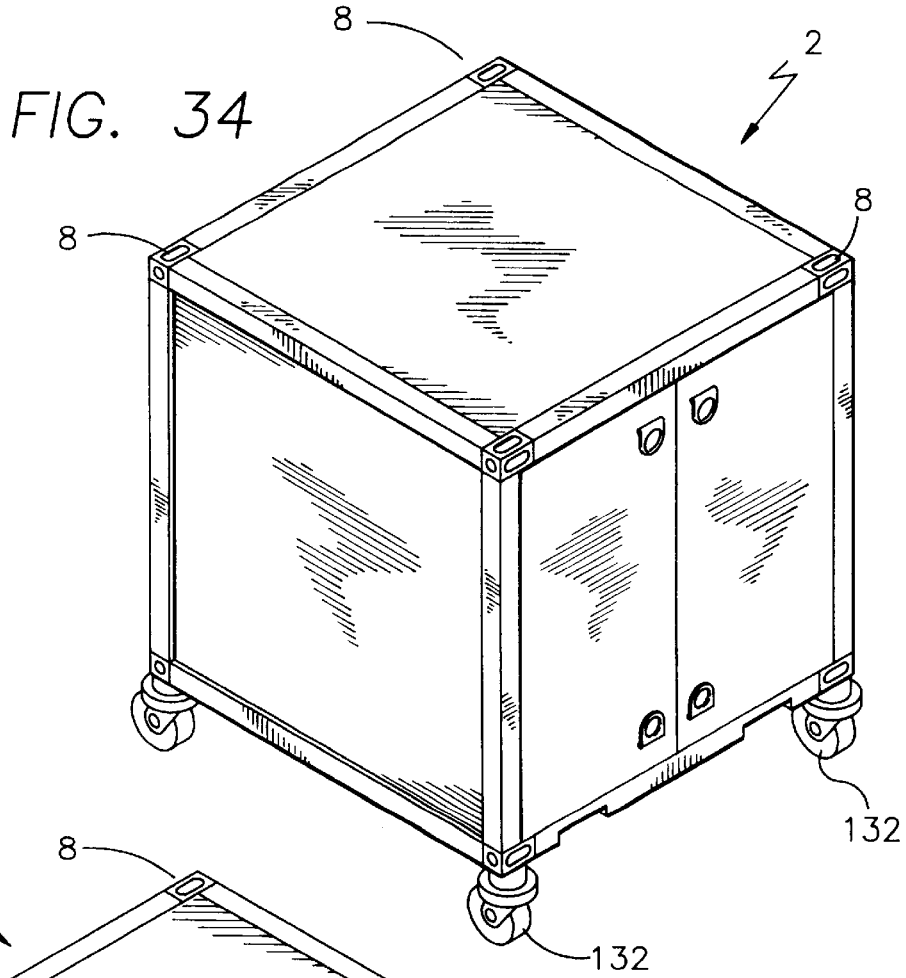
FIG. 34 is an isometric view of another embodiment of a transport and storage device.
Figure 35:
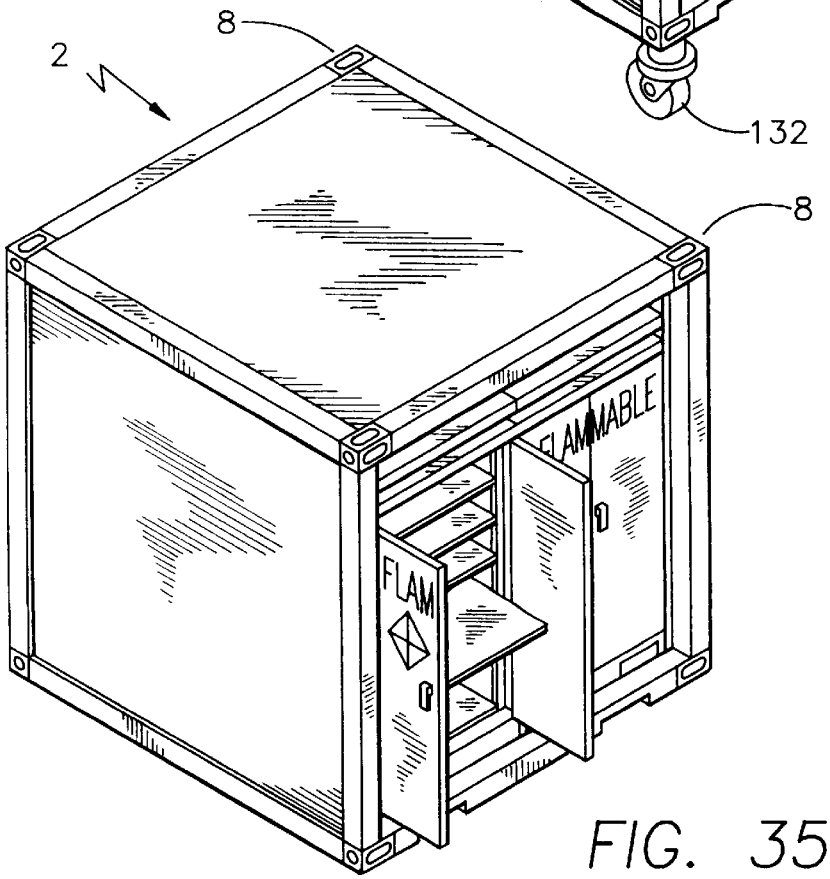
FIG. 35 is an isometric view of the device shown in FIG. 34 with the doors open.

FIGS. 34 and 35 are isometric views of another embodiment of a transport and storage device 2. In these figures, the device 2 has nominal dimensions of 8 ft×7 ft×7 ft. As illustrated in FIG. 36, and discussed above with reference to FIG. 1, the cargo container 4 may be used with various types of storage cabinets or modules 6 for accommodating a wide variety of cargo. Each of the storage modules 6 may also be provided with detachable wheels 132 as shown in FIG. 37.

FIG. 37 is a partial isometric view of a bottom side of a module 6 from FIG. 36. In FIG. 37, the bottom surface of the module is provided with positioners or locators 134 which are received by receptacles 15 in the floor of the module floor shown in FIGS. 2 and 36. The illustrated locators 134 are elongated projections having a trapezoidal cross section that fits into a corresponding trapezoidal recess in the receptacles 15. Triangular, spherical, rectangular, pentagonal, and other shapes may also be used for the locators 134 and receptacles 15.

Figure 38:
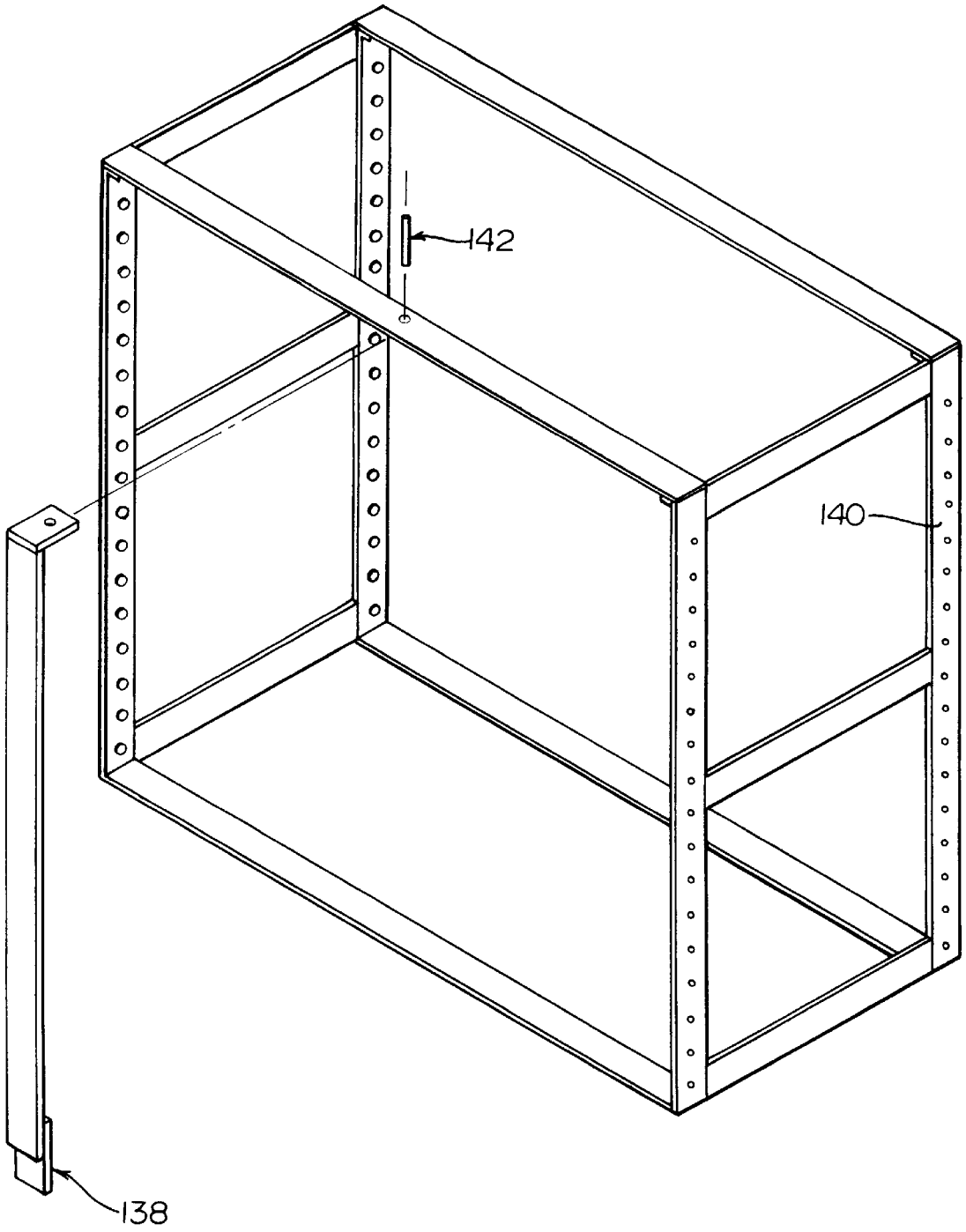
FIG. 38 is an isometric view of a storage module frame with a drawer securing bar.

As shown in FIG. 38, the storage modules 6 may be provided with a drawer securing bar 138 which is held to the module frame 140 by a pin 142, or other suitable locking mechanism on the side of the storage module 6 that is to be opened. The bar 138 prevents the drawers from opening during transit. The bar 138 and pin 142 are preferably sized and configured to withstand loads up to three times the force of gravity. Other locking mechanisms may also be provided on the individual drawers themselves.

Figure 40:
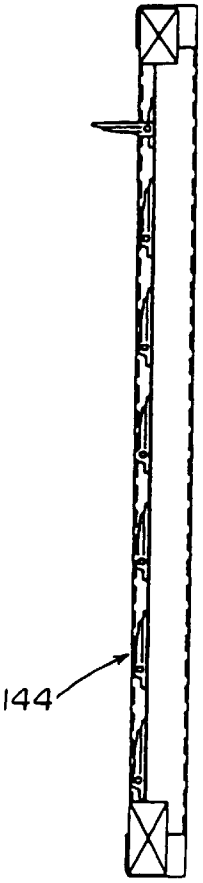
FIG. 40 PRIOR ART
FIG. 40 is a sectional view taken along section line 40–40' in FIG. 39.
Figure 39:
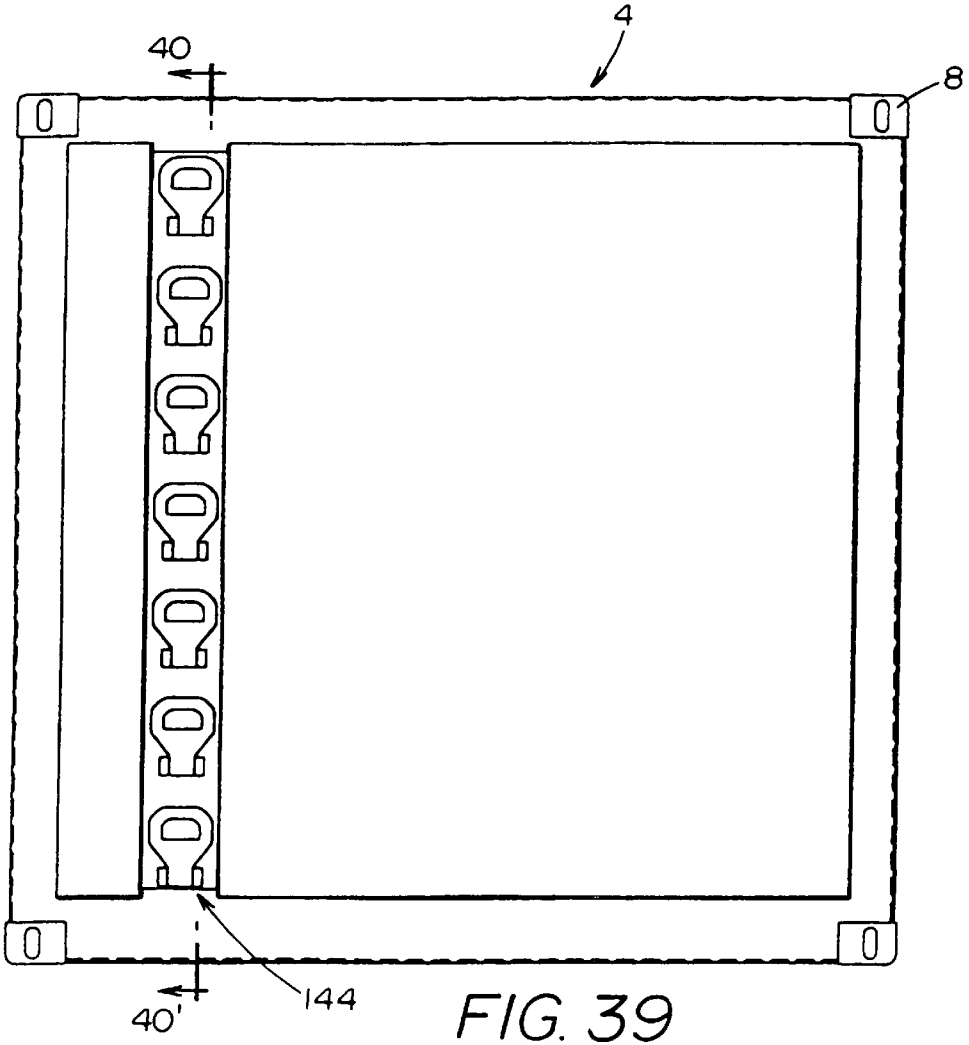
FIG. 39 PRIOR ART
FIG. 39 is a side elevational view of the device shown in FIG. 34 with folding steps.

FIGS. 39 and 40 illustrate foldable steps 144 which may be provided on the outer walls of the cargo container 4 for providing access to the roof of the container. One type of suitable step is the large folding footsteps/handholds, Part No. 1-585809, available from Eberhard Manufacturing Company. These steps are folded to retract along the sidewall of the container as illustrated in FIG. 40.

Figure 41:
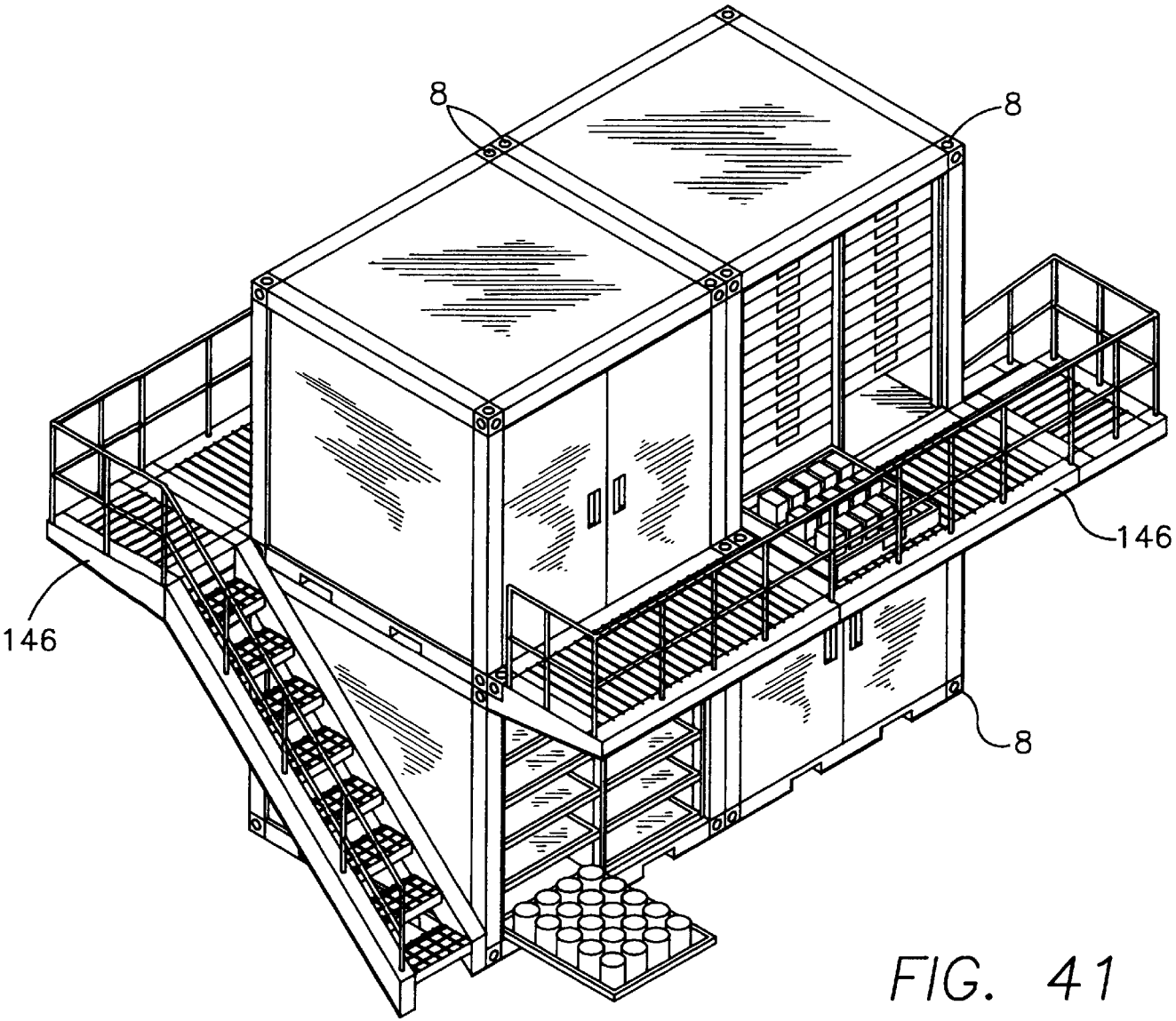
FIG. 41 is an isometric view of several of the devices shown in FIG. 34 which are stacked and fitted with a mezzanine and steps.

FIG. 41 is an isometric view of several cargo containers 4 from FIG. 36 which have been stacked and assembled with a mezzanine and ladder assembly 146. The mezzanine portion of the assembly is preferably about 4 feet wide by 7.3 feet long and has two male connectors (not shown) such as container securing fittings 70. The male connectors are spaced to fit in, and lock to, the lower corner blocks 8 of each of the top cargo containers 4, or to the upper corner blocks on the bottom containers. The ladder portion of the mezzanine similarly connects to one upper corner block (on the lower or upper container) and one corner block on the lower container. These mezzanine and ladder assemblies can be fitted on both sides of the containers 4.

Figure 42:
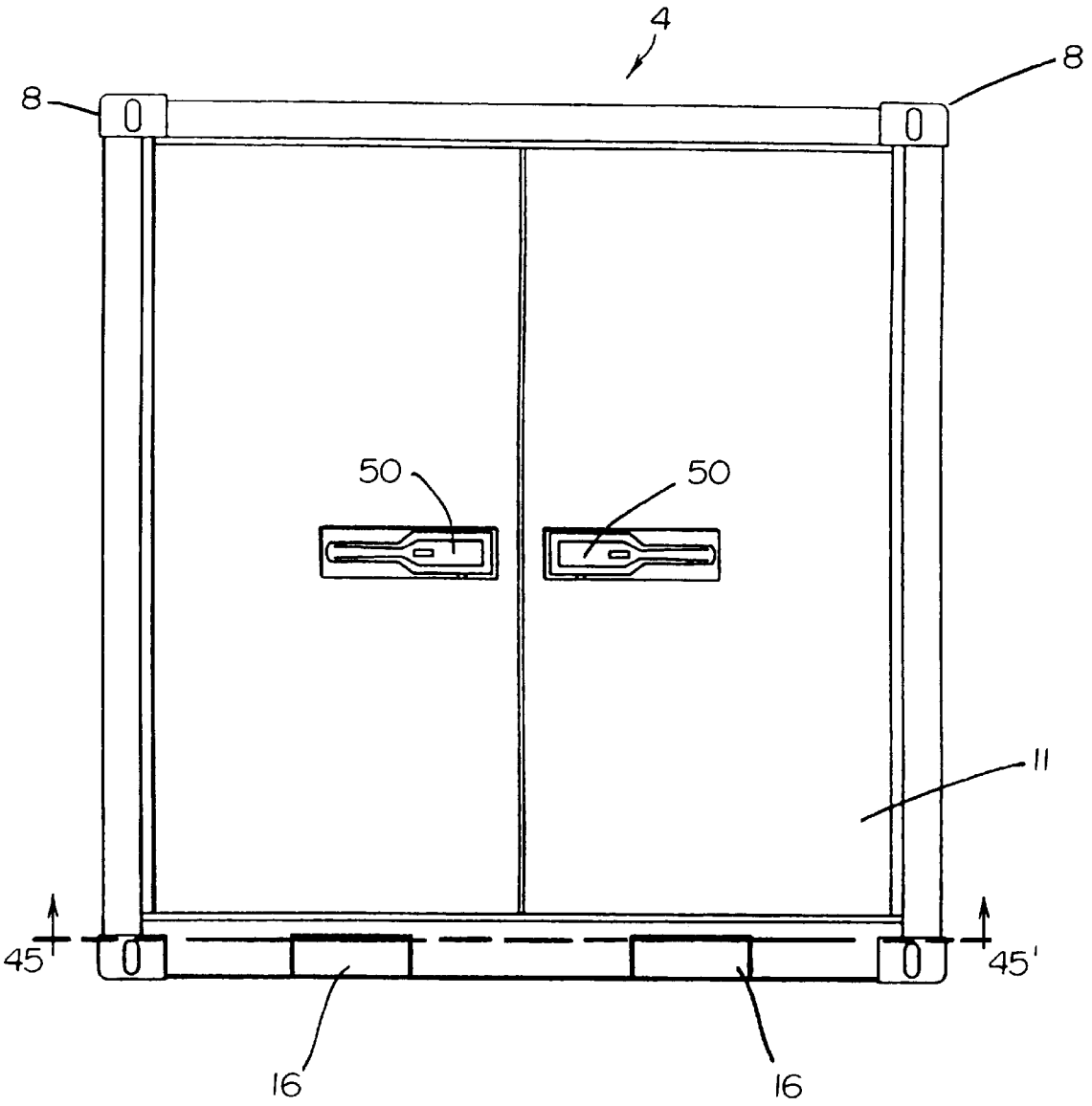
FIG. 42 is a side elevational view of the device shown in FIGS. 34 and 35 with the doors closed.

FIG. 42 is a side elevational view of the cargo container 4 shown in FIGS. 34 and 35 with the doors 11 in a closed position. Due to the smaller size of the cargo container 4 shown in FIG. 42, it only has two doors 11 on each side, each with a handle 50, and two forklift openings 16. However, other doors, handles, or forklift openings may also be provided.

Figure 43:
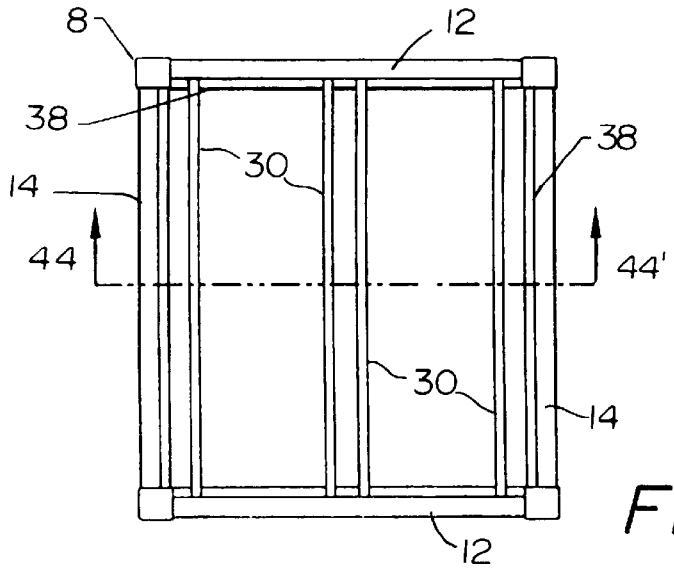
FIG. 43 is a plan view of a floor frame for use with the cargo container shown in FIG. 42.
Figure 44:
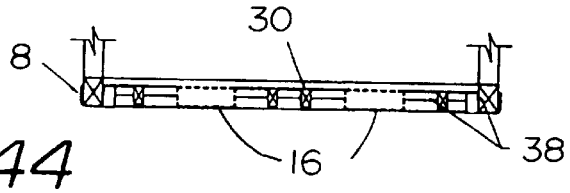
FIG. 44 is a sectional view taken along section line 44–44' in FIG. 43.
Figure 45:
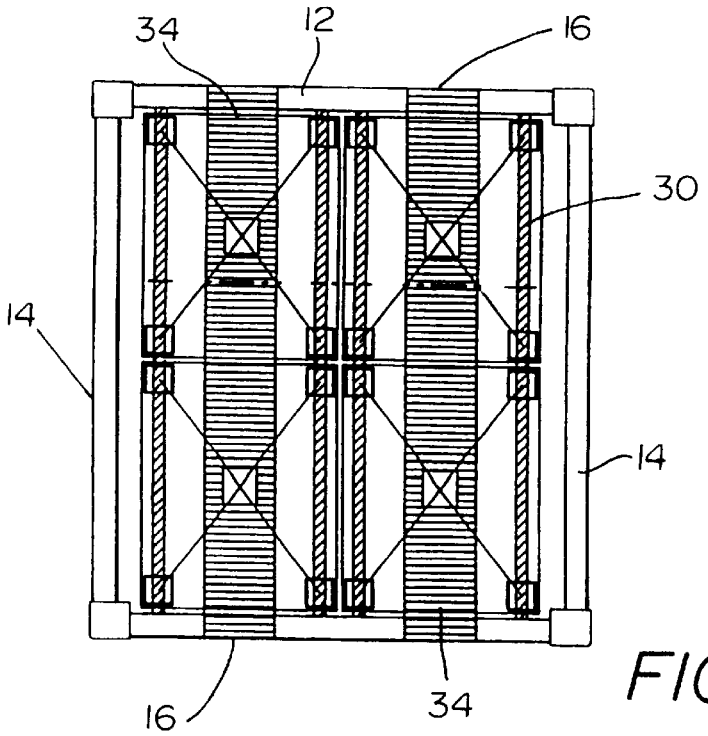
FIG. 45 is a schematic sectional view of an empty cargo container taken along section line 45–45' in FIG. 42.

FIG. 43 is a plan view of a floor frame for use with the cargo container 4 shown in FIG. 42, while FIG. 44 is a sectional view taken along section line 44–44' in FIG. 43. FIG. 45 is a schematic sectional view of an empty cargo container 4 taken along section line 45–45' in FIG. 42. In FIGS. 43–45, the floor frame has been modified to provide four bottom cross members 30. The floor frame shown in FIG. 43 is constructed substantially the same as the floor frame shown in FIG. 4 except that the bottom side members 12 and bottom end members 14 have been resized to 6"×4"×¼" rectangular tubing.

Figure 46:
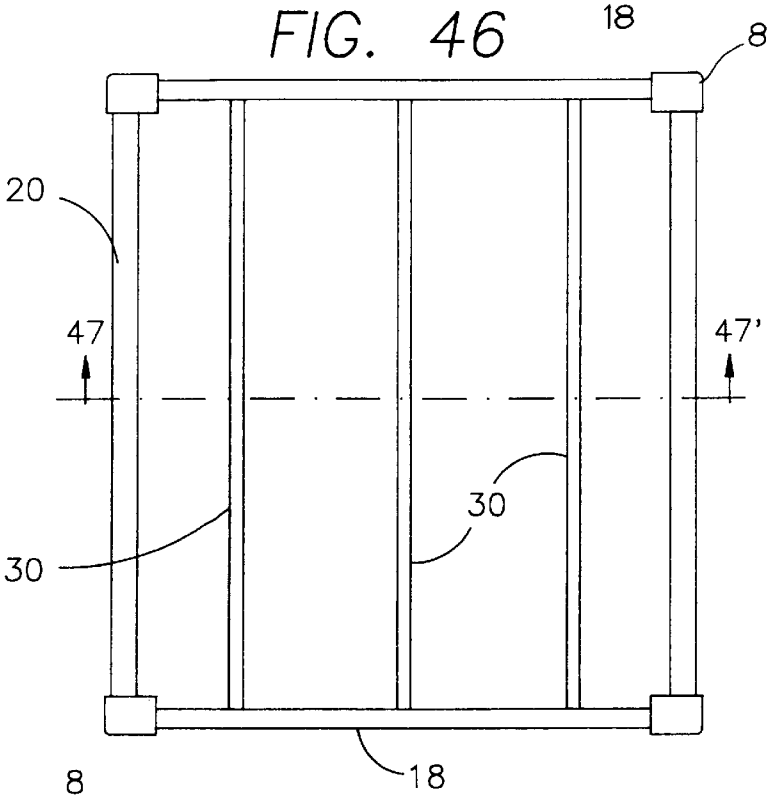
FIG. 46 is a plan view of a roof frame for use with the cargo container shown in FIG. 42.
Figure 47:
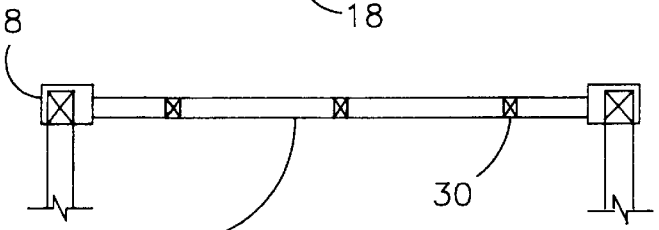
FIG. 47 is a sectional view taken along section line 47–47' in FIG. 46.

FIG. 46 is a plan view of roof frame for use with the cargo container 4 shown in FIG. 32, while FIG. 47 is a sectional view taken along section line 47–47' in FIG. 46. The roof frame shown in FIGS. 46 and 47 is constructed substantially the same as the roof frame shown in FIGS. 6 and 7. However, in FIGS. 46 and 47, the top cross members 30 are preferably 4"×2"×3/16" rectangular tubing, and both the top side members 18 and top end members 20 are preferably 4"×4"×3/16" square tubing.

Figure 48:
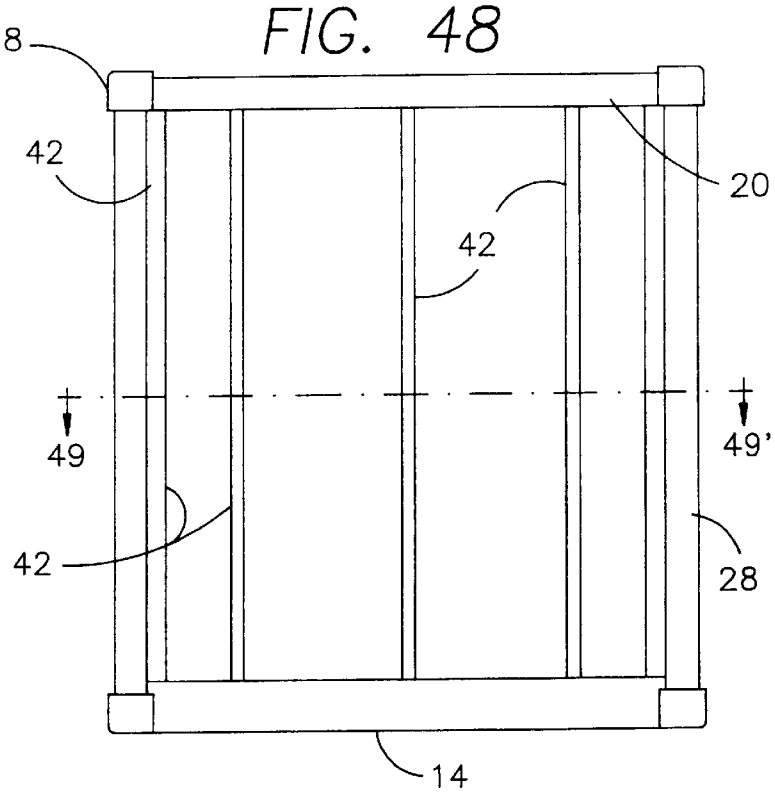
FIG. 48 is a side elevational view of end wall frame for use with the device shown in FIG. 42.
Figure 49:
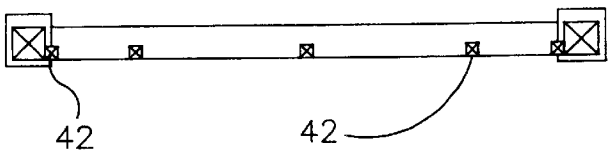
FIG. 49 is a sectional view taken along section line 49–49' in FIG. 48.

FIG. 48 is an elevational view of an end wall frame for use with the cargo container 4 shown in FIG. 32, while FIG. 49 is a sectional view taken along section line 49–49' in FIG. 48. In FIGS. 48 and 49, the end wall upright members 42 are preferably 2"×2"×16 gauge square tubing, while the corner upright members 28 are preferably 4"×4"×3/16" square tubing.

Figure 50:
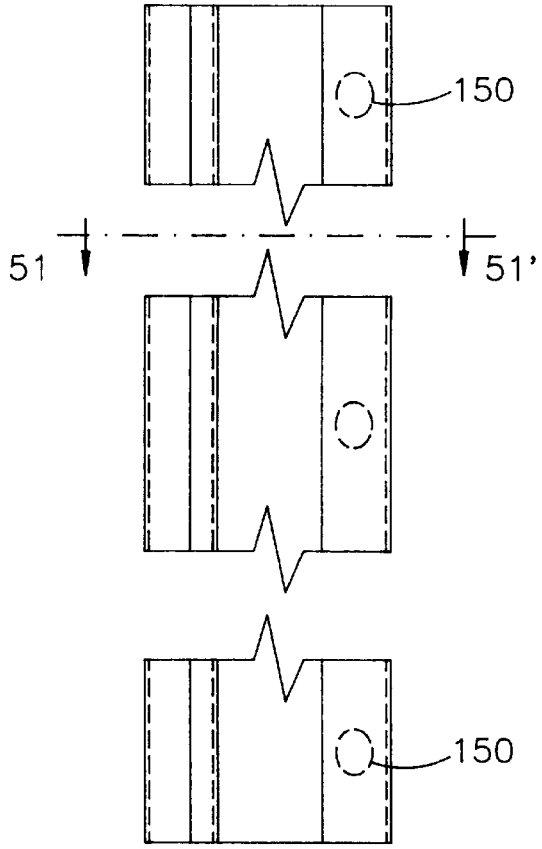
FIG. 50 is a side elevational view of a roller bracket.
Figure 51:
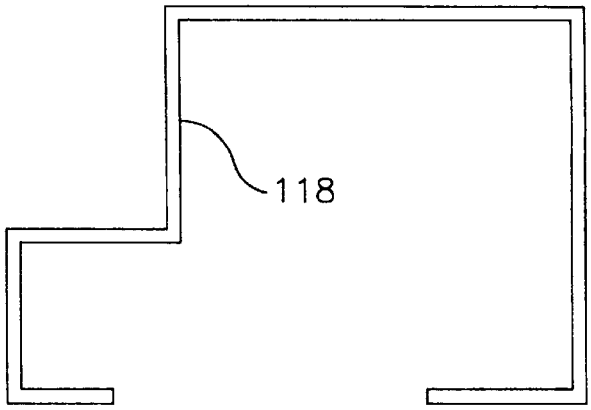
FIG. 51 is a sectional view taken along section line 51–51' in FIG. 50.

FIG. 50 is a side elevational view of a roller bracket 118, while FIG. 51 is a sectional view taken along section line 51–51' in FIG. 50. In FIG. 50, the roller bracket 118 is provided with a plurality of holes 150 for attaching to rollers 122 which roll inside each of the corresponding tracks.

Figure 52:
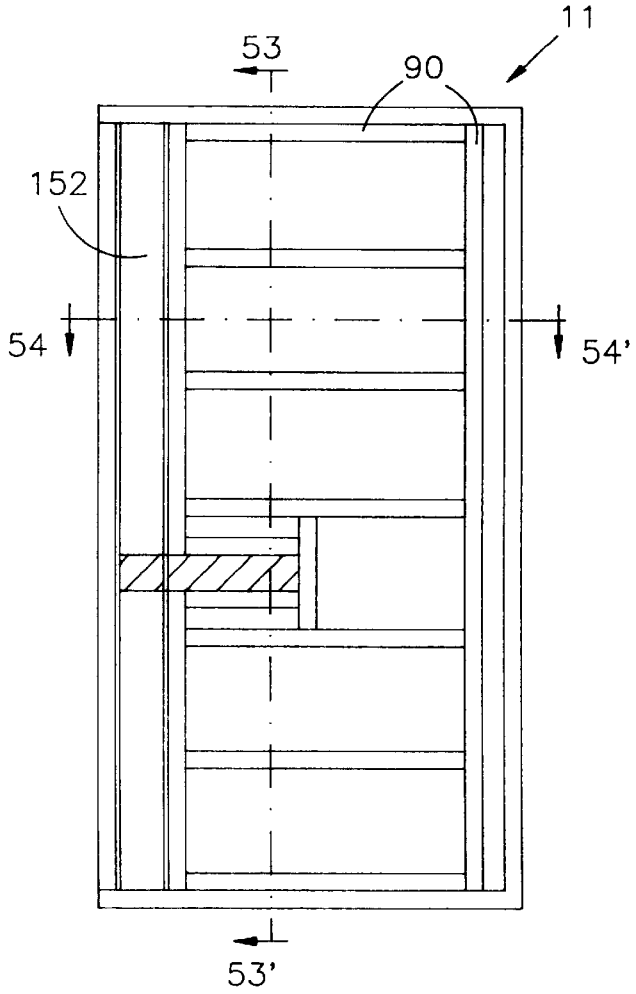
FIG. 52 is an inside elevational view of an alternative embodiment of a door.
Figure 53:
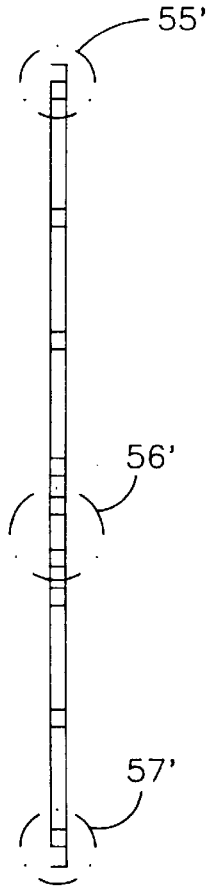
FIG. 53 is a sectional view taken along section line 53–53' in FIG. 52.
Figure 54:
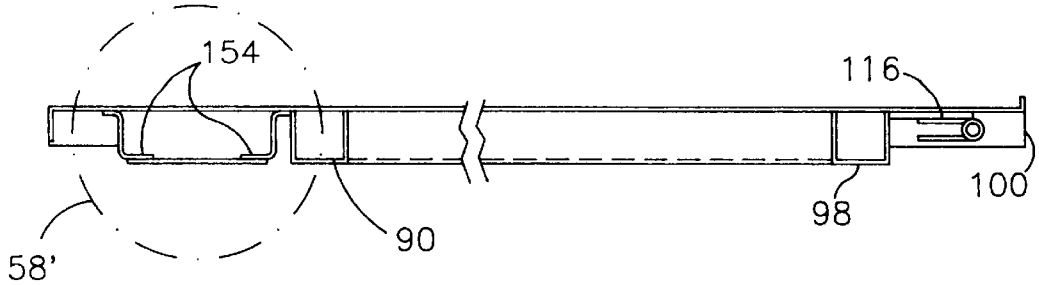
FIG. 54 is a sectional view taken along section line 54–54' in FIG. 52.
Figure 55:
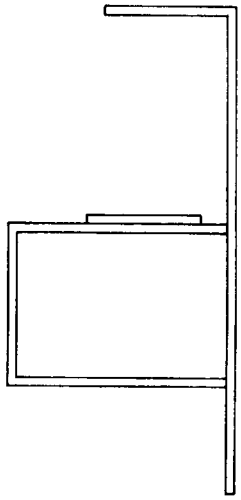
FIG. 55 is a detailed view of area 55' in FIG. 53.
Figure 56:
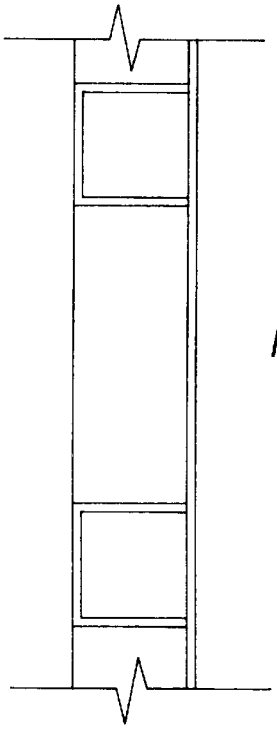
FIG. 56 is a detailed view of area 56' in FIG. 53.
Figure 57:
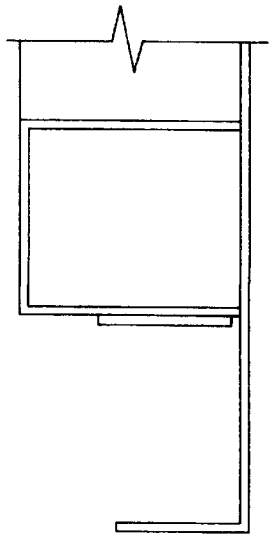
FIG. 57 is a detailed view of area 57' in FIG. 53.
Figure 58:
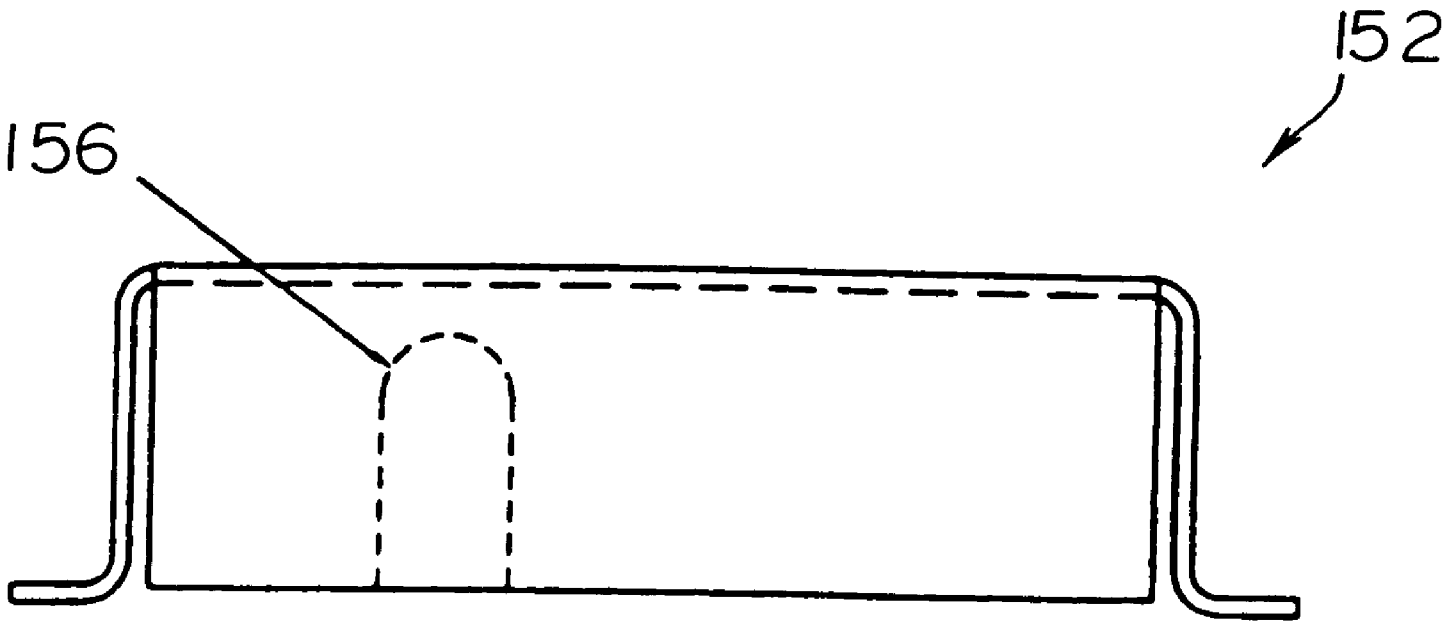
FIG. 58 is a detailed view of area 58' in FIG. 54.
Figures 63, 64, 65:
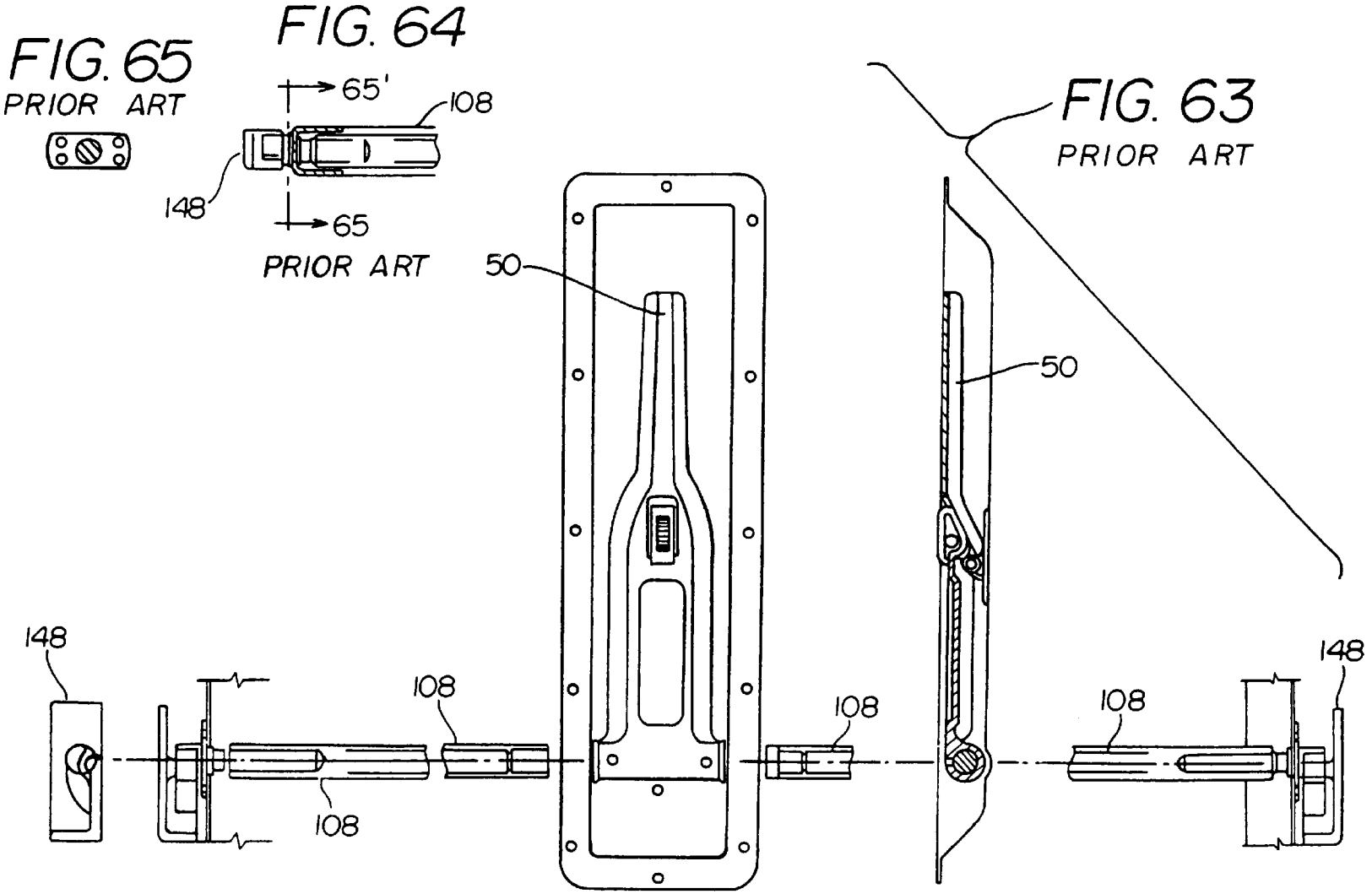
FIG. 63 PRIOR ART
FIG. 64 PRIOR ART
FIG. 65 PRIOR ART
FIG. 63 is a schematic assembly view of a latch mechanism.
FIG. 64 is a side view of a cam keeper on one end of the latch mechanism shown in FIG. 63.
FIG. 65 is a sectional view taken along section line 65–65' in FIG. 64.

FIG. 52 is an inside elevational view of an alternative embodiment of a door 11, while FIGS. 53 and 54 are sectional views taken along section lines 53–53' and 54–54' in FIG. 52. FIGS. 55–58 are detailed views of areas 55' through 58' in FIGS. 53 and 54. In FIGS. 52–58, the door stiffeners 90 are constructed with 14 gauge formed channels. In addition, the illustrated door 11 is provided with a 14 gauge removable access plate 152 for enclosing the linkage pipe 108 (not shown in FIGS. 52–58). The access panel 152 may be provided with rivet access holes 154 or other suitable joining means. As shown in FIG. 58, the top and bottom sides of the access panel 152 are provided with linkage pipe openings 156 through which the linkage pipe 108 extends. FIG. 63 illustrates one embodiment of a suitable latch mechanism including cam keepers 148 mounted on each end of a linkage pipe 108 which is rotatable by pulling a recessed handle 50.

Figure 60:
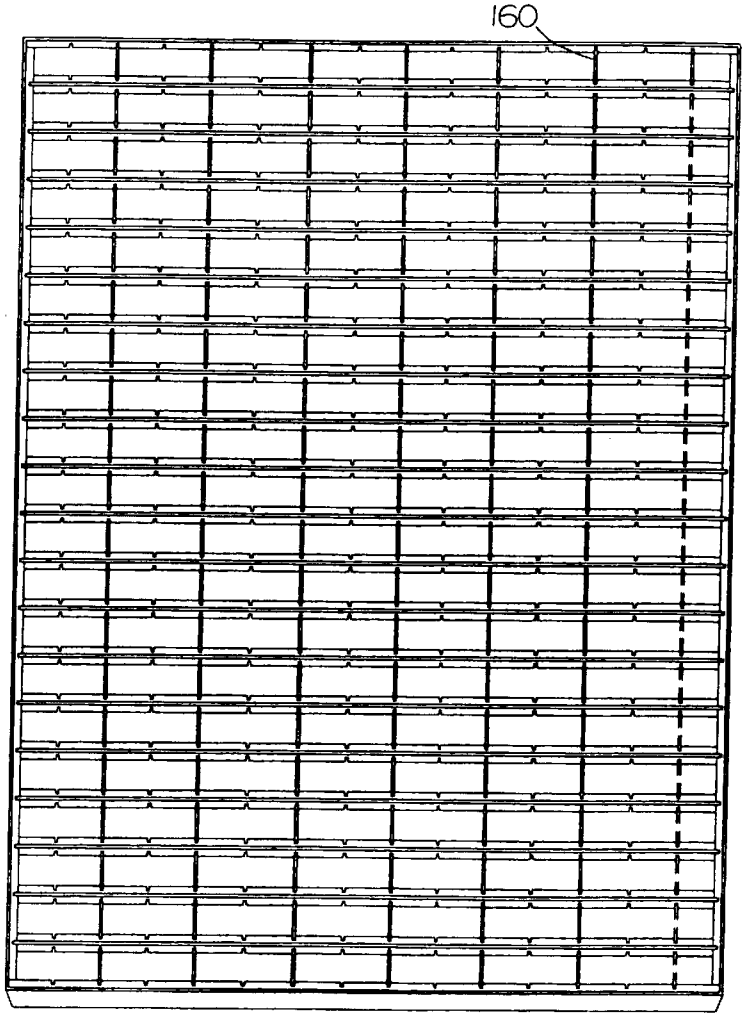
FIG. 60 is a modification of the storage module drawer divider shown in FIG. 59.
Figure 59:
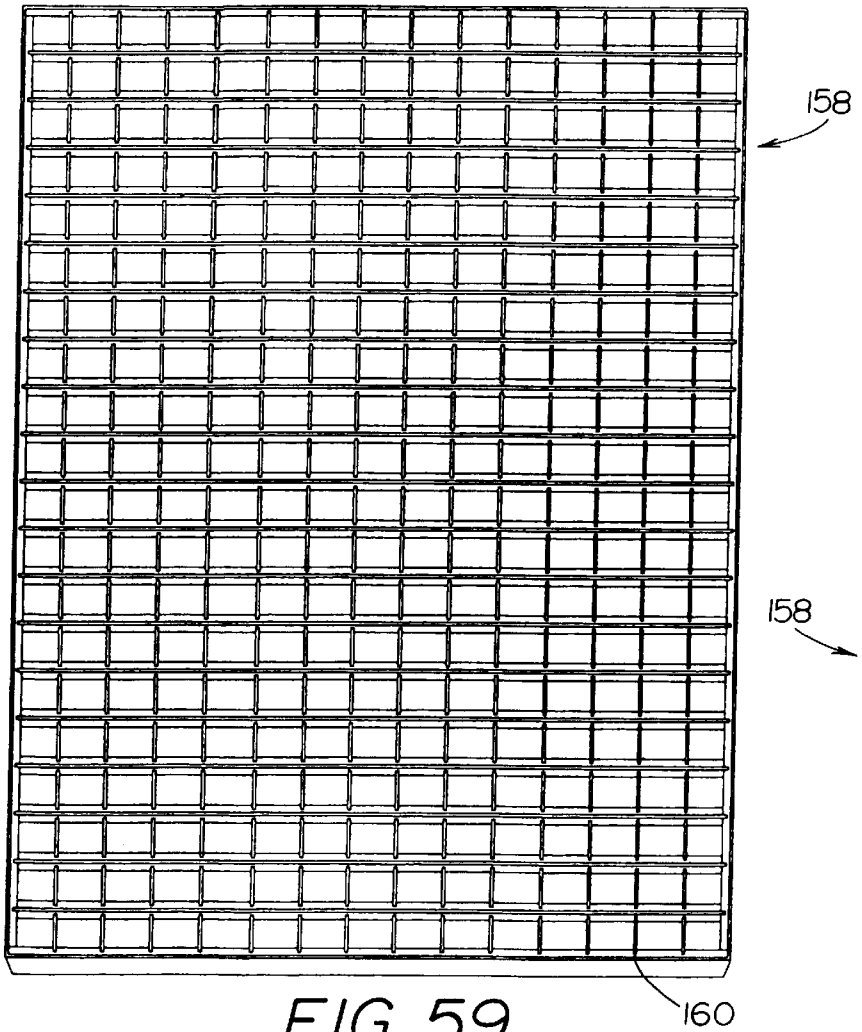
FIG. 59 is a top plan view of a storage module drawer divider.
Figure 62:
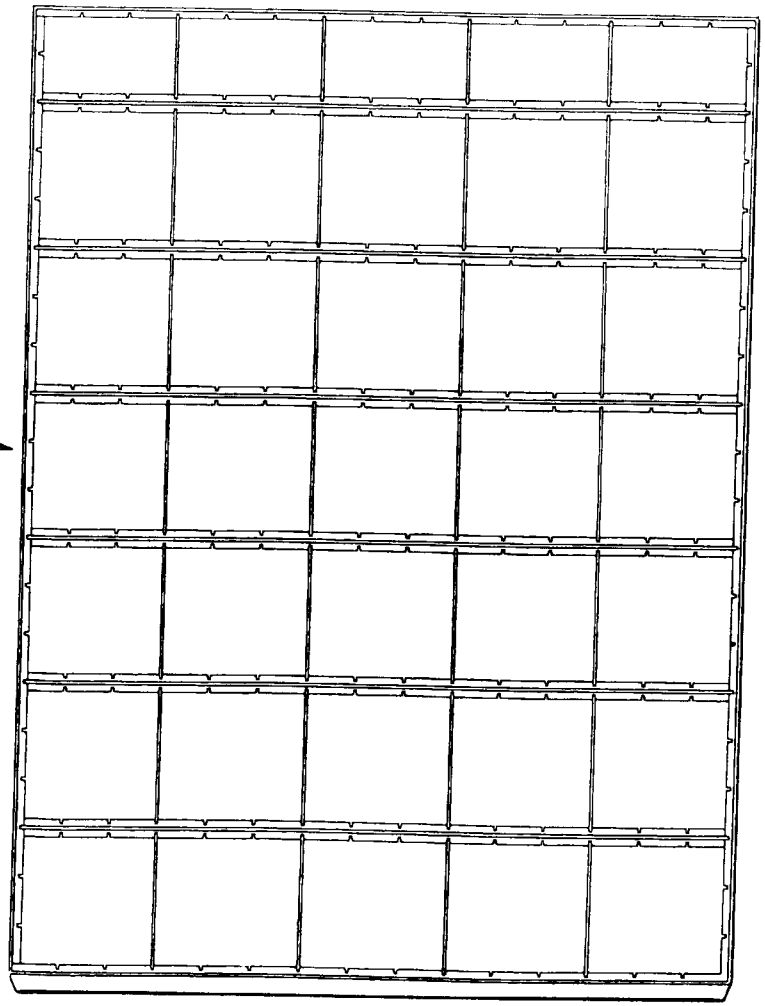
FIG. 62 is yet another modification of the storage module drawer divider shown in FIG. 59.
Figure 61:
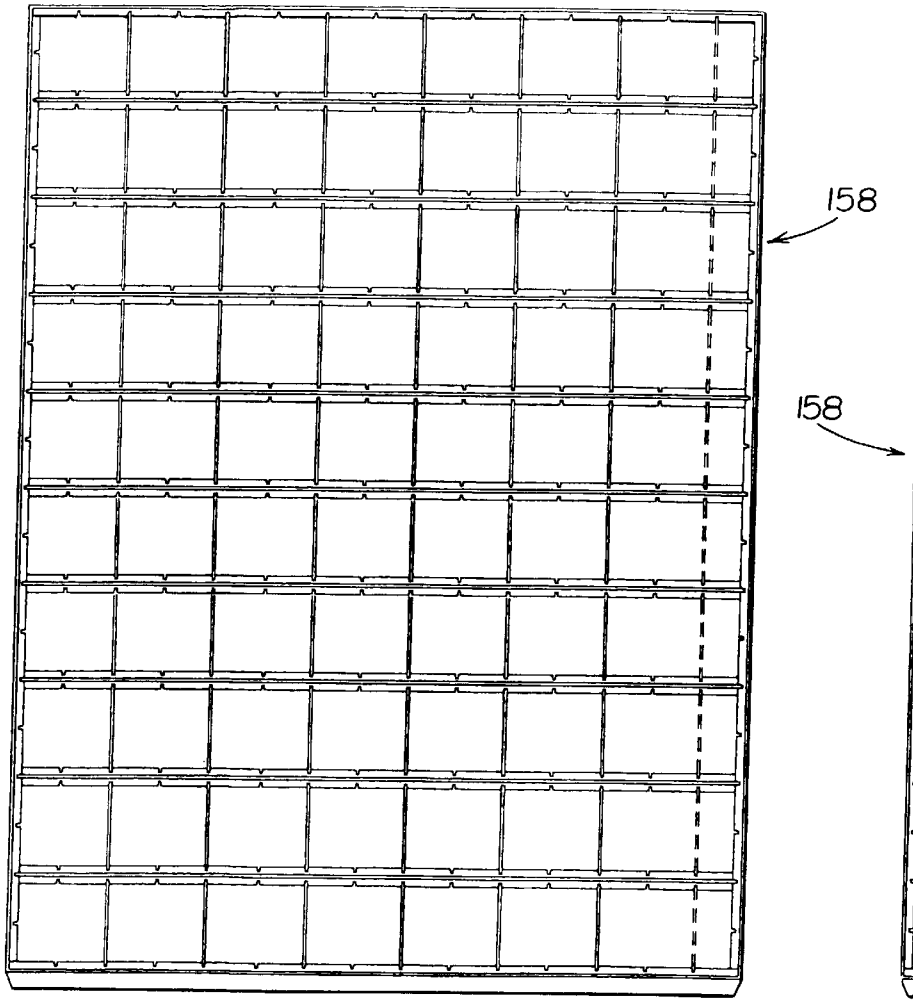
FIG. 61 is another modification of the storage module drawer divider shown in FIG. 59.

FIG. 59 is a top plan view of a storage module drawer divider which can be placed inside a typical drawer in a storage module 6 for creating multiple storage compartments inside a drawer. As illustrated in FIGS. 60–62, various walls 160 of the divider 158 may be moved and/or rearranged to provide a number of compartments of various shapes and sizes. FIG. 59 illustrates a storage module drawer divider 158 with 300 2"×2" spaces. FIG. 60 illustrates a drawer divider 158 with 140 2"×4" spaces and 22"×2" spaces. FIG. 61 illustrates a drawer divider 158 with 70 4"×4" spaces and 10 4"×2" spaces, while FIG. 62 illustrates a drawer divider with 30 6"×6" spaces and 5 6"×4" spaces.

The transport and storage system discussed above may be most effectively used by obtaining an authorized stockage list (ASL) of the material and supplies for any particular military unit. The volume of each item in the ASL can then be measured and indexed to a specific compartment in a specific drawer divider 158, in a specific drawer, in a specific storage cabinet, in a specific cargo container 4. Consequently, once the ASL is indexed in this manner against one or more transport and storage devices 2, any item can be easily located and removed from the device 2 during transport without having to unpack the entire container 4. In fact, it is expected that most of the equipment and supplies for a typical military unit currently requiring 7 forty-foot "M129" trailers (and three spare trailers) can be efficiently stored and transported in just one nominal 8 ft×8 ft×20 ft cargo container 4 with 10 storage modules 6 due to the more efficient use of container space allowed with the various embodiments discussed above. Of course, various oversized items may still have to be transported on flatbed trucks if they are too large to fit inside the dimensions of the cargo container 4.

The transport and storage system discussed above addresses the rugged demands of both military operations and commercial transportation as it pertains to the storage, handling, and transportation of a wide variety of supplies and materials. The system also allows for compliant shipping of multiple classes of materials utilizing a wide variety of transportation modes which include, but are not limited to ships, aircraft, helicopters, other military transport vehicles (truck, PLS, train, rough-terrain vehicles, etc.), and a wide range of commercial vehicles. The invention provides the segregation and the physical controls necessary for the efficient storage, handling, and transportation of supplies and materials during rapid deployment operations. The system can also be used at a home station as an expanded storage facility. When properly configured, the system requires minimal preparation for shipping by no more than a few individuals for a short period of time. The invention also replaces the plethora of specialized container systems currently in use by the five military services. The individual storage modules can be designed to be compliant with all governing directives for the storage and shipment of various materials in each module.

Although the invention has been described above with regard to various preferred embodiments, it will be readily understood to one of ordinary skill in the art that various changes and/or modifications may be made without departing from the spirit of the invention. In general, the invention is only intended to be limited by the properly construed scope of the following claims.

What is claimed is:

1. A transport and storage device, comprising:

a cargo container;

means for positioning at least one removable storage module inside the container; and means for releasably clamping a positioned storage module to the container.

2. The device recited in claim 1, wherein said positioning means includes a socket for receiving at least a portion of said module.

3. The device recited in claim 1, wherein said clamping means includes a container clamping fitting for clamping said storage module to the cargo container.

4. The device recited in claim 2, wherein said clamping means includes a container clamping fitting for clamping said storage module to the cargo container.

5. The device recited in claim 4, wherein said container clamping fitting is secured to a bracket on a floor of said cargo container for engagement with a corresponding bracket on a bottom side of said storage module.

6. The device recited in claim 5, further comprising foldable steps arranged on at least one side of the container.

7. The device recited in claim 6, further comprising mezzanine and stairs removably secured to the container.

8. The device recited in claim 7, wherein said mezzanine and stairs are secured by at least one container securing fitting to a corner fitting on said container.

9. The device recited in claim 4, further comprising:

a door pivotally connected to a side of the container by a hinge mounted on an inside surface of the door; and wherein said hinge and a hinged edge of the door are arranged entirely inside the container.

10. The device recited in claim 9, wherein said hinged edge of said door includes an angled projection; and a wall of said container includes a concave lip for receiving the projection when the door is closed.

11. The device recited in claim 10, wherein said projection extends substantially perpendicular to a front face of the door and said concave lip is L-shaped.

12. The device recited in claim 11, wherein said projection and L-shaped lip extend along substantially the entire length of the hinged edge of the door.

13. The device recited in claim 12, further comprising a weather seal arranged between said projection and said L-shaped lip.

14. The device recited in claim 10, further comprising means for sliding the door in and out of the container when the door is open.

15. The device recited in claim 11, further comprising means for sliding the door in and out of the container when the door is open.

16. The device recited in claim 12, further comprising means for sliding the door in and out of the container when the door is open.

17. The device recited in claim 13, further comprising means for sliding the door in and out of the container when the door is open.

18. The device recited in claim 4, wherein the cargo container has an unobstructed access opening and further comprises:

a pair of doors hinged to opposite edges of said access opening;

one of said doors having an angled projection extending from its free edge;

the other of said doors having a concave lip for receiving the projection when the doors are closed.

19. A transport and storage device recited in claim 18, wherein at least one of said doors further includes a second angled projection extending from a hinged end of the door; and said container further includes a second concave lip for receiving the second projection when the doors are closed.

20. The transport and storage device recited in claim 19, further comprising:

steps arranged on at least one side of the container; and a mezzanine removably secured to a corner fitting on the container with a container securing fitting.

21. The transport and storage device recited claim 20, further comprising a weather seal arranged between each of said projections and concave lips.

22. A transport and storage device comprising a cargo container including walls defining at least in part an enclosure; at least one access opening providing access to the enclosure; at least one door for closing said at least one access opening; said at least one door further defining said enclosure; at least one floor element; a first clamping fitting mounted on said at least one floor element; at least one moveable storage module configured and dimensioned so as to be moveable through said opening, to fit within said enclosure and to support and hold at least one item of cargo to be transported and stored within the cargo container; said storage module including a bottom portion including a second clamping fitting; said first and second clamping fittings configured to cooperate with each other such that when said clamping fittings are engaged and secured in locked relationship, said at least one storage module is clamped to said at least one floor element.

23. A transport and storage device as claimed in claim 22, said at least one floor element and said at least one storage module including engageable cooperating positioning and securing elements arranged when engaged to position and secure said module against substantial movement parallel to the floor element.

24. A transport and storage device as claimed in claim 22, wherein said cargo container walls define a container floor; and wherein said floor element is formed as an assembly including said first clamping fitting separate from said container floor; said floor element fixedly secure to said container floor.

25. A transport and storage device as claimed in claim 22, said cargo container including a plurality of said at least one floor element; a plurality of said at least one access opening; each said floor element including a first clamping fitting mounted on the floor element; a plurality of said at least one storage module, each of which is configured and dimensioned so as to be moveable through at least one of said at least one opening, to fit within said enclosure and to support and hold at least one item of cargo to be transported and stored; each said storage module including a bottom portion including a second clamping fitting;

said first and second clamping fittings configured to cooperate with each other such that when said first and second fittings are engaged in locked relationship, each storage module is clamped to a respective floor element.

26. A transport and storage device as claimed in claim 25, each said floor element and storage module including engageable cooperating positioning and securing elements arranged when engaged to position and secure each module against substantial movement parallel to a respective floor element.

27. A transport and storage device as claimed in claim 25, said cargo container walls defining a container floor, each said floor element being formed as an assembly including a first clamping fitting separate from said container floor; each respective floor element being secured to said container floor.

28. A transport and storage device as claimed in claim 22, 23, 24, 25, 26 or 27, said first and second clamping fittings comprising a rotatable head and a socket, both said socket and head being dimensioned to enable the socket to receive the head when the head is rotated to a first position and to enable the socket and head to be clamped to each other when the head is rotated to a second position.

29. A transport and storage device as claimed in claim 23, said engageable cooperating positioning and securing fittings comprising at least one foot and at least one receptacle, each of said at least one foot and said at least one receptacle mounted to either one of said at least one floor element and a bottom of said at least one storage module, and engaging each other when said at least one storage module is located in the enclosure and said first and second clamping fittings are engaged.

30. A transport and storage device as claimed in claim 29, wherein said engageable cooperating positioning and securing fittings comprise a plurality of said at least one foot and a plurality of said at least one receptacle, a respective foot engaging a respective receptacle when said at least one storage module is located in the enclosure and said first and second clamping fittings are engaged.

31. A transport and storage device as claimed in claim 30, wherein each receptacle is raised above said at least one floor element and each foot extends below said at least one storage module, whereby said at least one storage module must be located above the floor element and lowered towards the floor element so that each foot is lowered into and engages a respective receptacle to position and secure said at least one module relative to a respective floor element.

* * * * *